US009744400B2

(12) United States Patent
Cole

(10) Patent No.: US 9,744,400 B2
(45) Date of Patent: Aug. 29, 2017

(54) EXERCISE APPARATUS

(71) Applicant: Emilia Cole, Aspen, CO (US)

(72) Inventor: Emilia Cole, Aspen, CO (US)

( * ) Notice: Subject to any disclaimer, the term of this patent is extended or adjusted under 35 U.S.C. 154(b) by 0 days.

(21) Appl. No.: 14/781,406

(22) PCT Filed: Jun. 3, 2015

(86) PCT No.: PCT/US2015/034021

§ 371 (c)(1),
(2) Date: Sep. 30, 2015

(87) PCT Pub. No.: WO2016/053393

PCT Pub. Date: Apr. 7, 2016

(65) Prior Publication Data

US 2017/0197109 A1 Jul. 13, 2017

Related U.S. Application Data

(60) Provisional application No. 62/058,140, filed on Oct. 1, 2014.

(51) Int. Cl.
*A63B 22/00* (2006.01)
*A63B 21/02* (2006.01)
(Continued)

(52) U.S. Cl.
CPC ..... *A63B 22/0089* (2013.01); *A47B 67/005* (2013.01); *A47B 81/00* (2013.01);
(Continued)

(58) Field of Classification Search
CPC ..... A63B 21/4035; A63B 21/00047; A63B 2210/50; A63B 21/0552; A63B 21/4029; A63B 21/4033; A63B 2208/0204; A63B 2225/093; A63B 2225/09; A63B 21/4031; A63B 21/4047; A63B 2208/0242; A63B 21/0421; A63B 21/078; A63B 26/00; A63B 21/00; A63B 21/04; A63B 22/00; A63B 21/02; A47C 17/52; A47C 17/38; A47C 17/48; A47C 17/62; A47C 17/42; A47C 17/46; A47C 17/58; A47C 17/04; A47C 17/50; A47C 19/20; A47C 17/24;
(Continued)

(56) References Cited

U.S. PATENT DOCUMENTS 332,989 A 12/1885 Benedict
1,776,204 A * 9/1930 Tascarella ..... A61G 13/105 269/901
(Continued)

OTHER PUBLICATIONS

Teagues Pilates Studio. Hide-A-Way Reformer. Published Aug. 25, 2014 on Facebook. https://www.facebook.com/permalink.php?story_fbid=435710023235863&id=307506812722852.*
(Continued)

*Primary Examiner* — Andrew S Lo
(74) *Attorney, Agent, or Firm* — Cook Alex Ltd.

(57) ABSTRACT

Exercise apparatus that provides increased functionality and utilization of space is disclosed. The exercise apparatus may include improved storage features and one or more exercise modules and storage modules that may be combined in an exercise apparatus for use in various environments, so as to provide more efficient use of floor space.

24 Claims, 14 Drawing Sheets

(51) Int. Cl.

| | |
|---|---|
| ***A63B 21/04*** | (2006.01) |
| ***A63B 21/00*** | (2006.01) |
| ***A47B 67/00*** | (2006.01) |
| ***A47B 81/00*** | (2006.01) |
| ***A47C 17/52*** | (2006.01) |
| ***A47C 17/38*** | (2006.01) |

(52) U.S. Cl.
CPC ..... *A47C 17/38* (2013.01); *A47C 17/52* (2013.01); *A63B 21/023* (2013.01); *A63B 21/0428* (2013.01); *A63B 21/0442* (2013.01); *A63B 21/154* (2013.01); *A63B 21/4035* (2015.10); *A63B 21/4039* (2015.10); *A63B 21/4045* (2015.10); *A63B 2210/06* (2013.01); *A63B 2210/50* (2013.01); *A63B 2225/09* (2013.01)

(58) Field of Classification Search
CPC ..... A47C 19/045; A47C 17/86; A47C 19/12; A47C 9/06
USPC ..... 482/142; 5/136
See application file for complete search history.

(56) References Cited

U.S. PATENT DOCUMENTS

| | | | | |
|---|---|---|---|---|
| 2,219,219 | A | 10/1940 | Boger | |
| 2,632,645 | A * | 3/1953 | Barkschat | A63B 3/00 108/39 |
| 2,770,813 | A | 11/1956 | Marzillier | |
| 2,788,528 | A * | 4/1957 | Hansen | A47C 17/48 5/149 |
| 3,042,978 | A * | 7/1962 | Eames | A47B 47/00 108/48 |
| 3,129,676 | A * | 4/1964 | Brooks | A47B 77/10 108/33 |
| 3,226,115 | A | 12/1965 | Underhill | |
| 3,770,267 | A | 11/1973 | McCarthy | |
| 3,874,657 | A | 4/1975 | Niebojewski | |
| 4,300,761 | A * | 11/1981 | Howard | A63B 17/00 482/130 |
| 4,431,181 | A * | 2/1984 | Baswell | A63B 21/154 482/102 |
| 4,679,787 | A | 7/1987 | Guilbault | |
| 4,829,610 | A * | 5/1989 | Gonzalez-Alvarez | A47C 17/38 182/34 |
| 4,979,731 | A | 12/1990 | Hermelin | |
| 5,066,005 | A | 11/1991 | Luecke | |
| D404,443 | S * | 1/1999 | Doyle | D21/675 |
| 6,338,704 | B1 | 1/2002 | Endelman | |
| 6,454,683 | B1 | 9/2002 | Kaye | |
| 6,574,807 | B1 * | 6/2003 | Gonzalez | A47C 17/58 5/149 |
| 6,971,976 | B2 | 12/2005 | Endelman et al. | |
| 7,104,937 | B2 | 9/2006 | Arbuckle et al. | |
| 7,125,369 | B2 | 10/2006 | Endelman | |
| 7,294,098 | B2 | 11/2007 | Barnard et al. | |
| 7,465,261 | B2 | 12/2008 | Barnard et al. | |
| 7,591,763 | B1 | 9/2009 | Fucci | |
| 7,614,988 | B1 | 11/2009 | Kiser | |
| 7,651,452 | B2 | 1/2010 | Weir et al. | |
| 7,803,095 | B1 | 9/2010 | LaGree | |
| 7,833,144 | B1 | 11/2010 | Como et al. | |
| 7,878,954 | B2 | 2/2011 | McBride et al. | |
| 7,927,262 | B2 | 4/2011 | Clark | |
| 8,020,713 | B2 * | 9/2011 | Crincoli | A47F 7/0028 211/106.01 |
| 8,075,454 | B2 | 12/2011 | Piggins | |
| 8,128,540 | B2 | 3/2012 | Savsek et al. | |
| 8,192,338 | B2 | 6/2012 | Solow et al. | |
| 8,506,459 | B2 | 8/2013 | Cassidy et al. | |
| 8,506,462 | B2 | 8/2013 | Gregor et al. | |
| 8,568,281 | B2 | 10/2013 | Beaulieu et al. | |
| 8,602,953 | B2 | 12/2013 | Jordan | |
| 8,632,444 | B2 | 1/2014 | McBride et al. | |
| 8,734,308 | B1 | 5/2014 | Joslin | |
| 8,915,829 | B2 | 12/2014 | Endelman et al. | |
| 9,108,079 | B2 * | 8/2015 | Solow | A63B 21/055 |
| 2003/0119635 | A1 | 6/2003 | Arbuckle et al. | |
| 2004/0014571 | A1 | 1/2004 | Haynes | |
| 2005/0113227 | A1 * | 5/2005 | Endelman | A63B 21/04 482/142 |
| 2005/0164855 | A1 | 7/2005 | Li et al. | |
| 2006/0252616 | A1 * | 11/2006 | Gerschefske | A63B 5/00 482/142 |
| 2007/0087902 | A1 | 4/2007 | Penat et al. | |
| 2007/0219053 | A1 * | 9/2007 | Barufka | A63B 5/00 482/4 |
| 2008/0070763 | A1 | 3/2008 | Greene | |
| 2008/0248935 | A1 * | 10/2008 | Solow | A63B 21/4037 482/142 |
| 2010/0043142 | A1 | 2/2010 | Whitford | |
| 2011/0224059 | A1 | 9/2011 | Crawley | |
| 2012/0015787 | A2 | 1/2012 | Strong Crawley et al. | |
| 2012/0083394 | A1 | 4/2012 | Gregor et al. | |
| 2015/0076092 | A1 | 3/2015 | Tambornino et al. | |
| 2016/0096062 | A1 * | 4/2016 | Moerth-Cross | A61G 13/105 482/101 |

OTHER PUBLICATIONS

Teagues Hide-A-Way Reformer. https://www.pinterest.com/source/teaguepilates.com/.*

International Preliminary Report on Patentability for PCT/US2015/034021 dated Oct. 7, 2016.

Intl. Search Report and Written Opinion for PCT/US2015/034021 dated Aug. 31, 2015.

Clayton Woodworks Publication; http://claytonwoodworks.blogspot.com; date Unknown.

Teague Pilates Equipment Information; http://www.teaguepilates.com/ reformer--hide-a-way.html; date Unknown.

* cited by examiner

EXERCISE APPARATUS

CROSS REFERENCE TO RELATED APPLICATION

This application claims the benefit of U.S. Provisional Patent Application Ser. No. 62/058,140, filed Oct. 1, 2014, the disclosure of which is hereby incorporated by reference in its entirety.

BACKGROUND

This invention relates to exercise equipment, such as Pilates equipment and in particular to improved exercise equipment that can be stored in a reduced volume while permitting better utilization of floor space.

Pilates is widely practiced with exercise equipment that is specifically designed for the Pilates program. See for example the exercise equipment disclosed in the following U.S. Pat. Nos. 7,125,369 B2 and 7,104,937 B2, and U.S. Patent Application Publications 20110183822 A1 and 20120283079 A1.

See also the Hide-A-Way Reformer, marketed by Teague Pilates Equipment (www.teaguepilates.com/reformer-hide-a-way.html. For storage, such a Pilates reformer can be tilted into a cabinet that rests on a floor surface and has a side-hinged door, having a vertical pivot axis. Another piece of exercise equipment that can be tilted into a cabinet for storage is shown in U.S. Pat. No. 2,632,645.

SUMMARY

The purpose and advantages of the disclosed subject matter will be set forth in and apparent from the description and drawings that follow, as well as will be learned by practice of the claimed subject matter. While the exercise apparatus and methods of use within the present disclosure are shown with respect to particular example embodiments, it will be understood that the structures and principles of operation also may be utilized with alternative structures and accessories.

The present disclosure is directed to exercise equipment that may provide increased functionality and utilization of space by including improved storage features as compared to that identified above, and that may provide a set of exercise modules and storage modules that may be combined in an exercise apparatus for use in various environments, such as a health club, a Pilates studio, a home, an apartment or the like, so as to provide more efficient use of floor space. The following is intended to highlight certain advantages of the preferred embodiments described in detail below, without limiting the scope of the invention.

The preferred embodiments described below provide an exercise apparatus that may include functions of a conventional Pilates Reformer. The exercise apparatus may include a wall unit that is fixed to a wall and a floor unit that is hinged relative to the wall unit to move between a lowered position on the floor and a raised position adjacent the wall unit. The wall unit may provide functions of a Pilates Tower, and the floor unit may include a sliding platform and springs, pulleys, cables, ropes and/or straps that allow a user on the sliding platform to move the platform against resistance, such as may be provided by spring forces. For this reason, the wall unit and floor unit together may be referred to as a Pilates module. When the floor unit is raised to a storage position, the exercise apparatus may be configured to reside in a position spaced above the floor for ease of floor cleaning, and in any event, occupies little volume and floor space within a room, and the large majority of the floor space occupied when the floor unit was down is made available for other uses. The exercise apparatus may include one or more Pilates modules and one or more storage modules.

In one embodiment, the bottom panel of the floor unit, when in the lowered position, may become the visible front of a Pilates module, when in the raised position. This bottom panel also may help to form a large storage compartment in the floor unit to hold exercise accessories, shoulder rests, ropes, springs and/or other items when the floor unit is in the lowered and/or raised positions. This makes for a compact, attractive, and well-organized appearance when the Pilates module of the exercise apparatus is stored with the floor unit in the raised position.

In one aspect, the present disclosure provides an exercise apparatus for use in a room having a floor and a wall. The exercise apparatus includes a wall unit extending parallel to the wall and a floor unit hinged to rotate between a raised position adjacent the wall unit and a lowered position adjacent or above the floor. The floor unit further includes a pair of spaced apart first side supports, a carriage platform being movable between the first side supports toward and away from the wall unit when the floor unit is in the lowered position, at least one spring coupled to the carriage platform to bias the carriage platform in a selected direction; and at least one strap coupled to the carriage platform to allow a user to pull the carriage platform in a direction opposite the selected direction.

Other features and advantages of the preferred embodiments will be explained in the following detailed description.

BRIEF DESCRIPTION OF THE DRAWINGS

In describing the preferred embodiments, reference is made to the accompanying drawing figures wherein like parts have like reference numerals, and wherein.

Figure 1A:
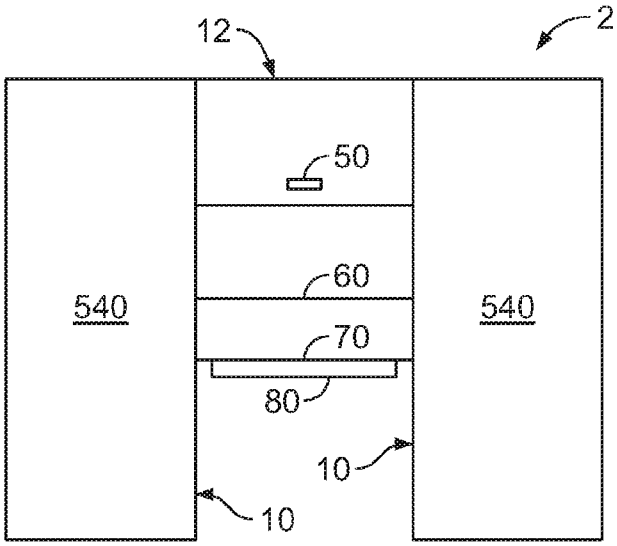
FIG. 1*a* is a front elevation view of an exercise apparatus 2 in a preferred embodiment that includes three modules, with two Pilates modules 10 positioned on opposite sides of a storage module 12.
Figure 3A:
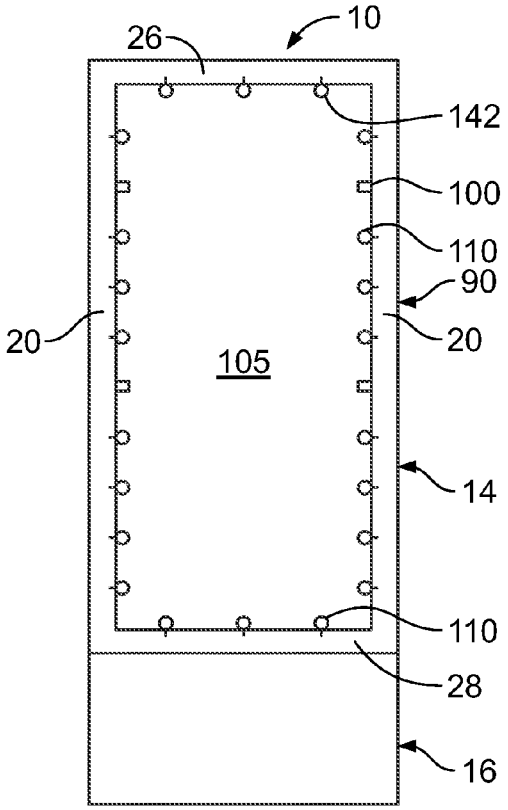
FIG. 3*a* is a front elevation view of the Pilates module 10 of the exercise apparatus 2 of FIG. 1*a*, with the floor unit 16 in the lowered position, and showing details of the wall unit 14 before springs and bars have been installed.
Figure 3B:
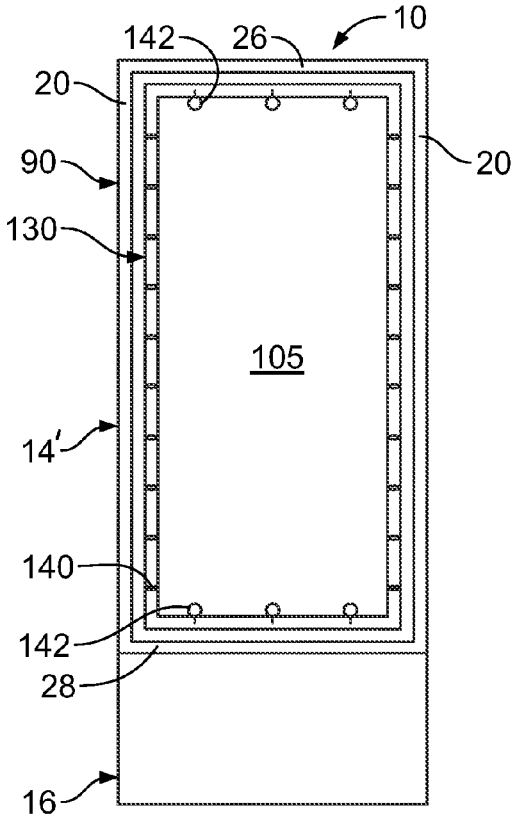

FIG. 3*b* is a front elevation view of a Pilates module 10', which is an alternative to the Pilates module 10 of the exercise apparatus 2 of FIG. 1*a*, with a floor unit 16 in the lowered position, and showing details of the alternative wall unit 14' before springs and bars have been installed.

Figure 4A:
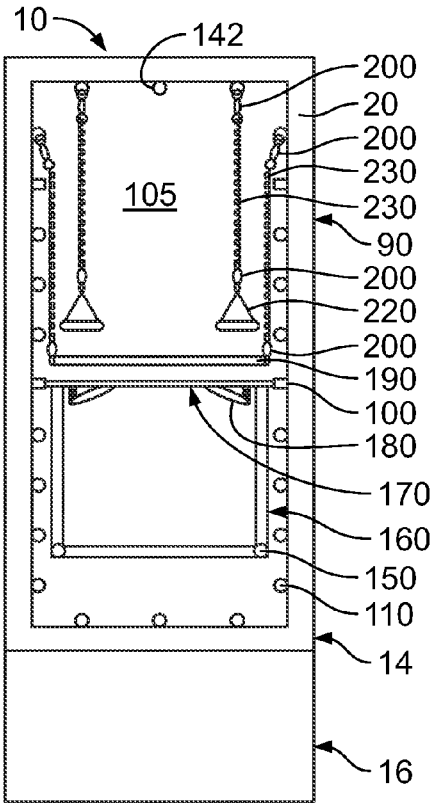

FIG. 4*a* is a front elevation view of the Pilates module 10 of FIG. 3*a*, with the floor unit 16 in the lowered position, and showing springs and bars installed in the wall unit 14.

Figure 4B:
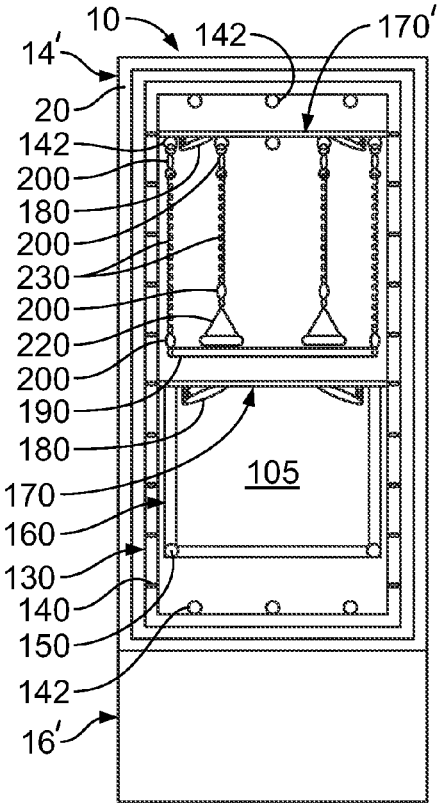

FIG. 4*b* is a front elevation view of the Pilates module 10' of FIG. 3*b*, with the floor unit 16 in the lowered position, and showing springs and bars installed in the wall unit 14'.

Figure 5A:
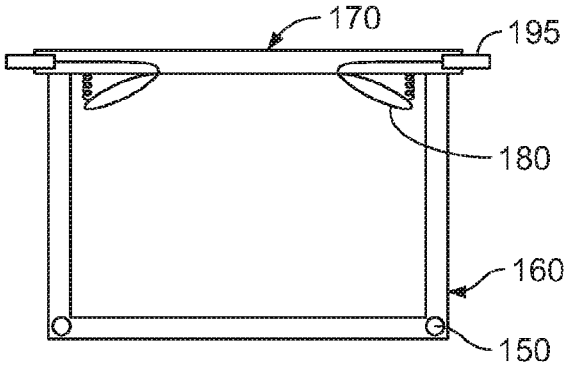

FIG. 5*a* is a detailed schematic view of a first accessory bar 170 shown in FIGS. 4*a* and 4*b*.

Figure 5B:
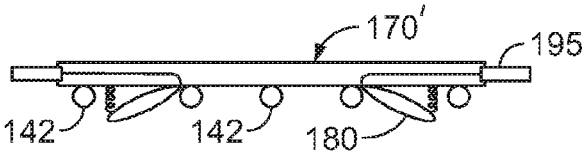

FIG. 5*b* is a detailed schematic view of a second accessory bar 170' shown in FIG. 4*b*.

Figure 5C:
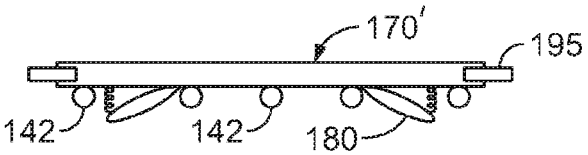
Figure 5D:
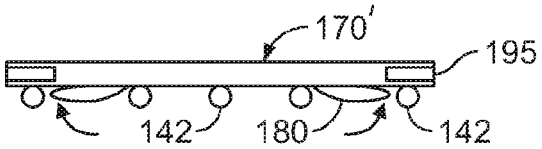
Figure 5E:
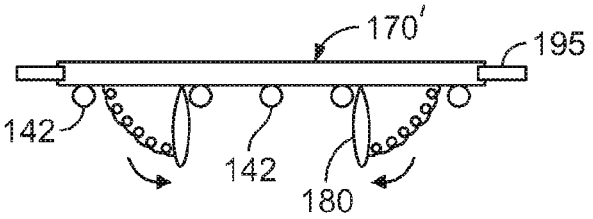

FIGS. 5*c*, 5*d*, and 5*e* are detailed schematic views that show the splined ends of the second accessory bar 170' in the partially-extended, retracted, and fully extended positions, respectively.

Figure 5F:
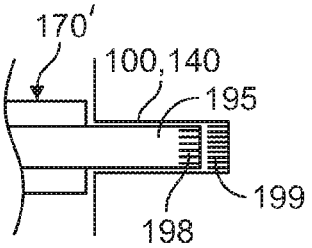
Figure 5G:
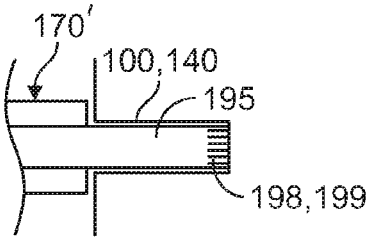

FIGS. 5*f* and 5*g* are further detailed schematic views that show the cooperation between one of the splined ends of the second accessory bar 170' and a corresponding splined hub when the splined end is in the partially extended and the fully extended positions, respectively.

Figure 6A:
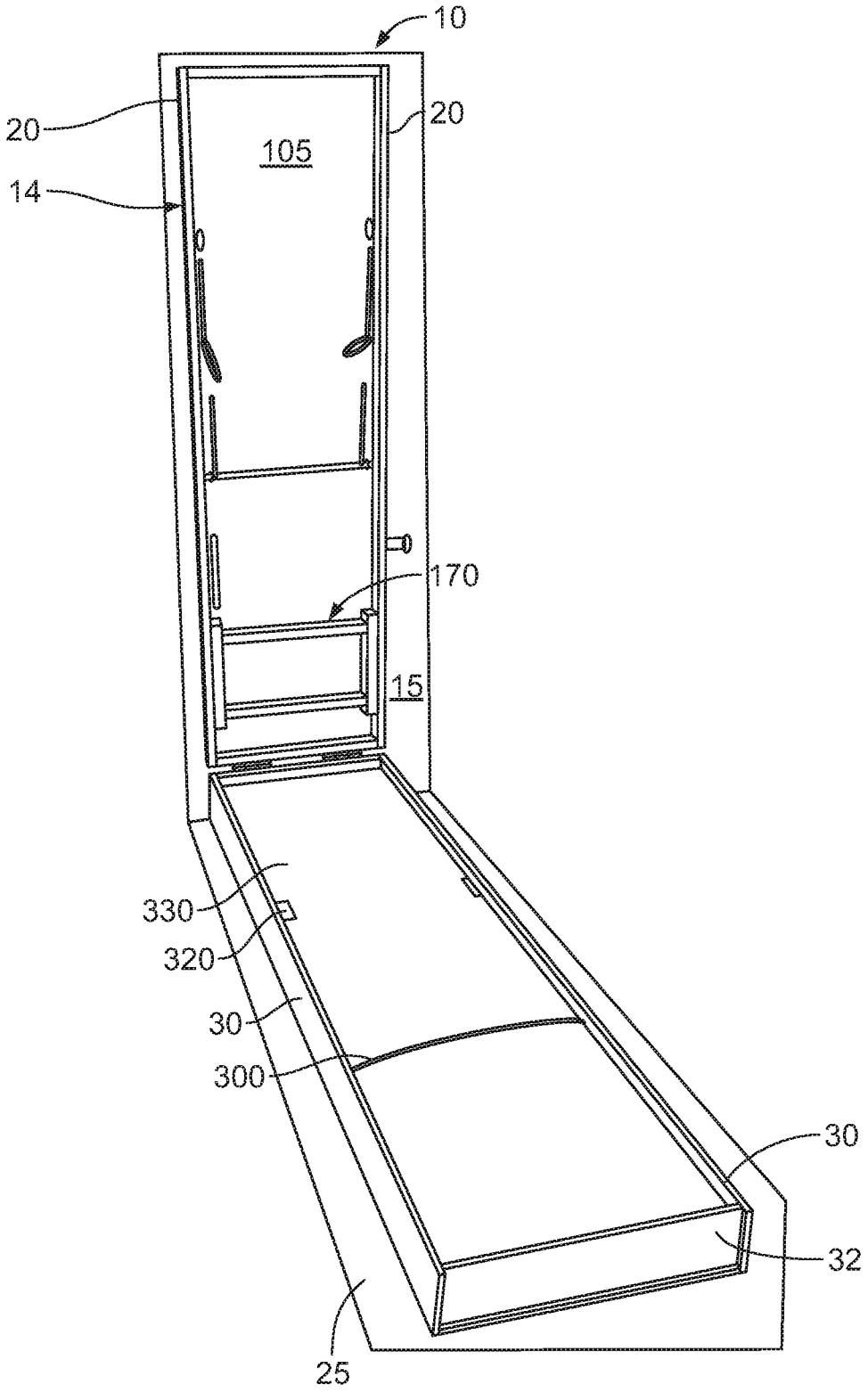

FIG. 6*a* is a front perspective view of the Pilates module 10 of the exercise apparatus 2 of FIG. 1*a*, with the floor unit 16 in the lowered position and having a filler platform 300 and a carriage platform 330 installed.

Figure 6D:
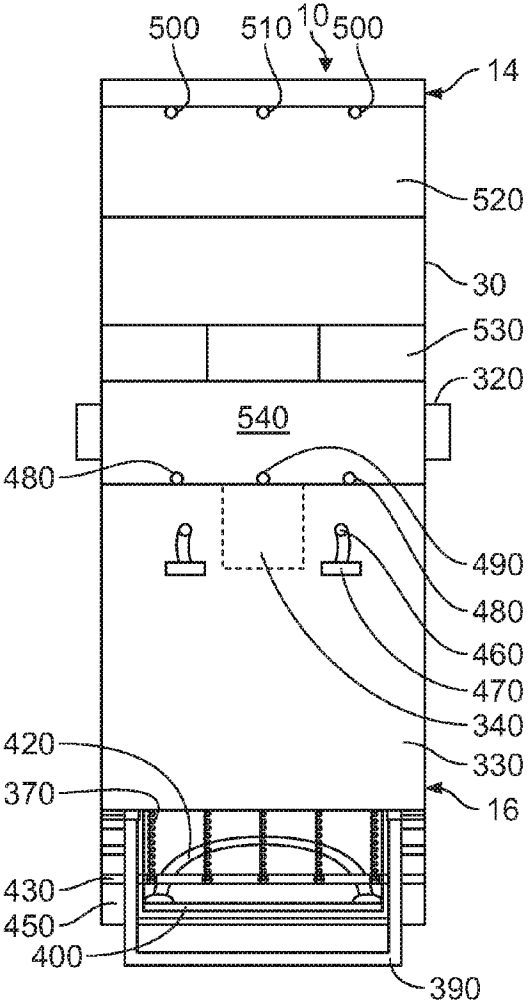
Figure 6C:
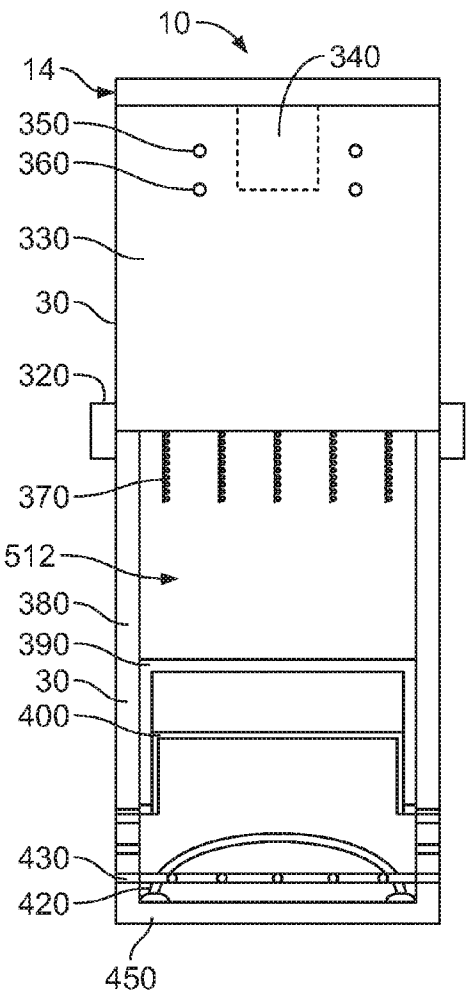
Figure 6B:
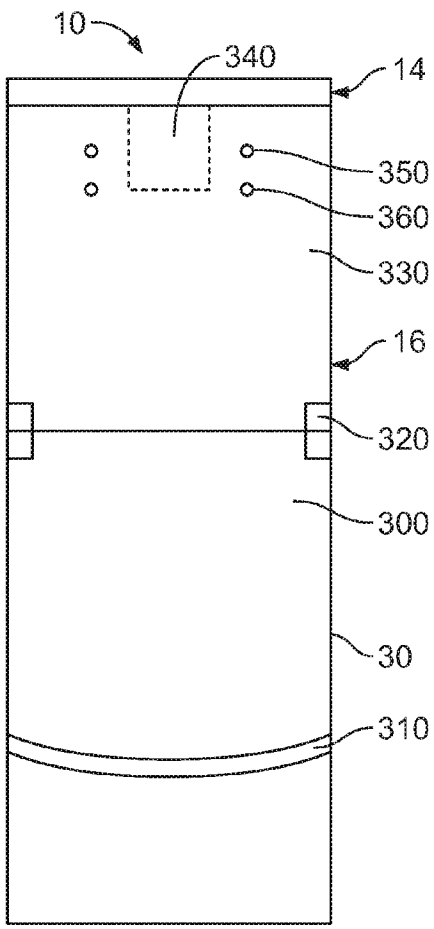

FIG. 6*b* is a top plan view corresponding to FIG. 6*a*, showing the filler platform 300 and carriage platform 330 installed in the floor unit 16.

FIG. 6*c* is a top plan view of the Pilates module 10 of FIG. 6*a*, showing the filler platform 300 removed to reveal further details of the floor unit 16.

FIG. 6*d* is a top plan view corresponding to FIG. 6*c*, showing the filler platform 300 removed and the carriage platform 330 moved away from the wall unit 14 to reveal further details of the floor unit 16.

Figure 7C:
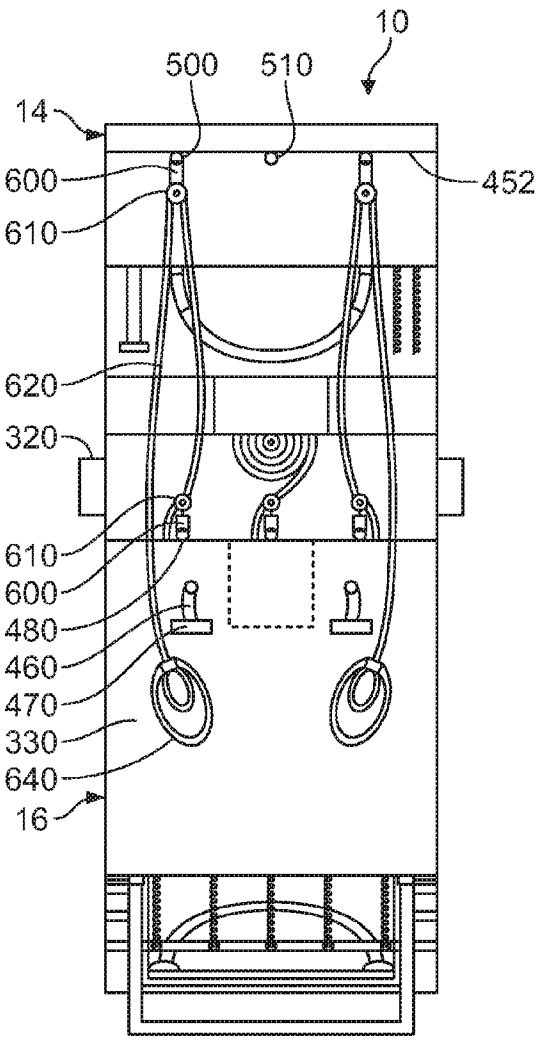
Figure 7B:
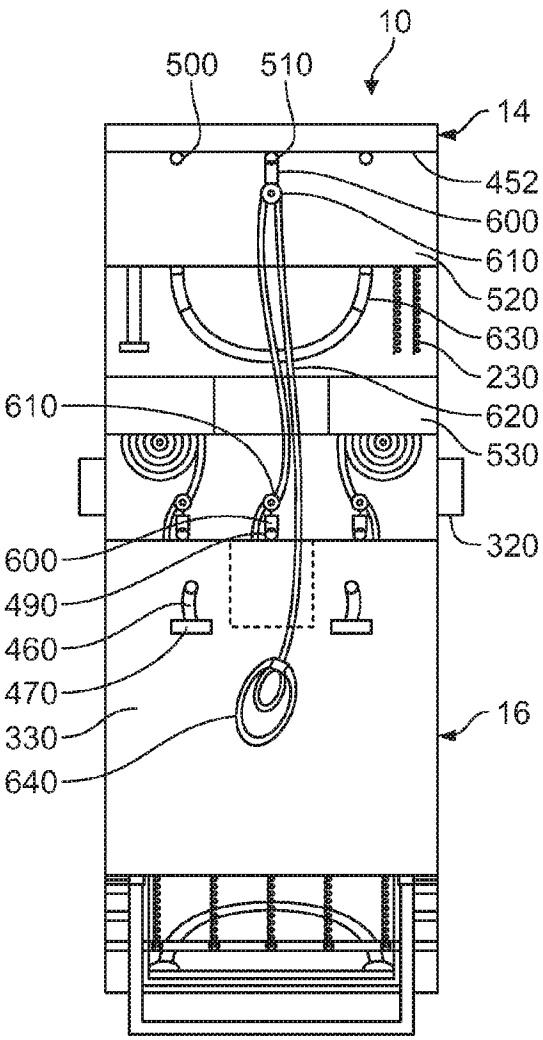
Figure 7A:
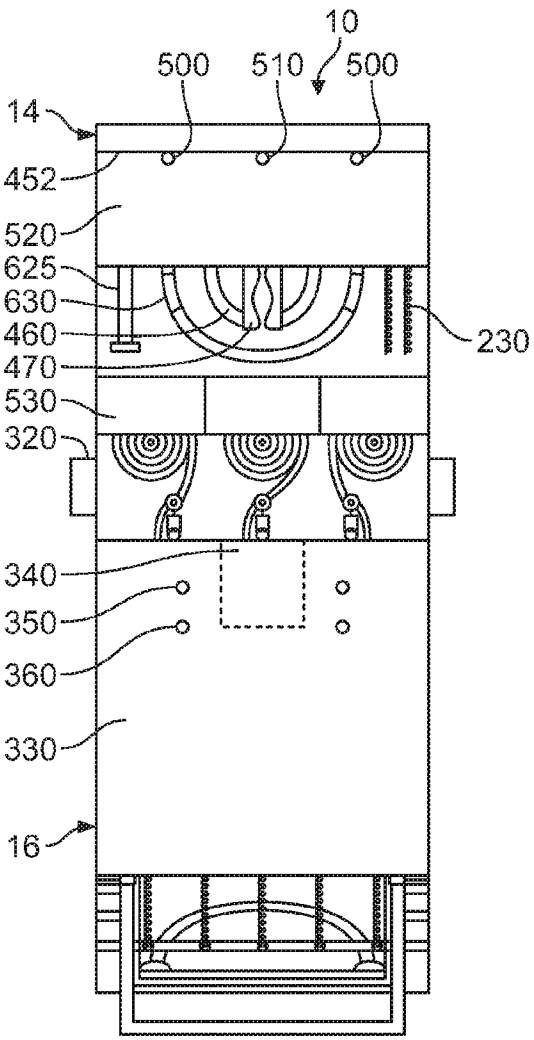

FIGS. 7*a*, 7*b*, and 7*c* are top plan views corresponding to the configuration shown in FIG. 6*d*, with each view showing further details of accessories that can be used with the floor unit 16.

Figure 8A:
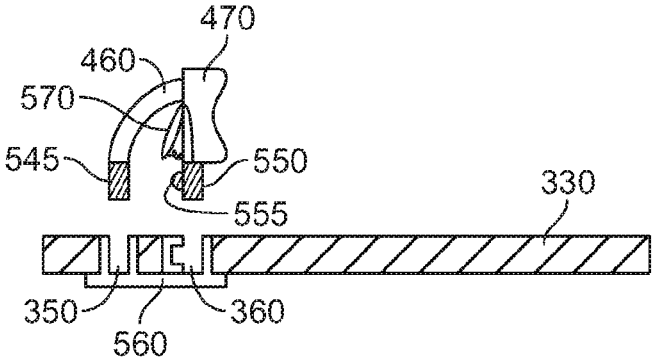
Figure 8B:
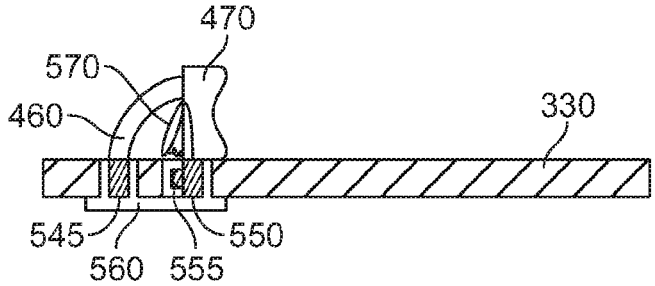

FIGS. 8*a* and 8*b* are detail views in partial section showing how the shoulder rest 470 may be releasably connected to the carriage platform 330.

Figure 9A:
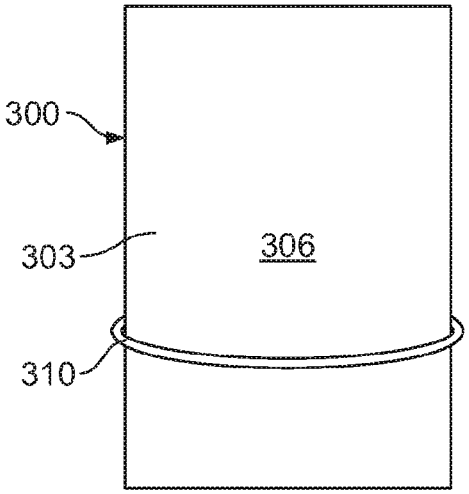
Figure 9B:
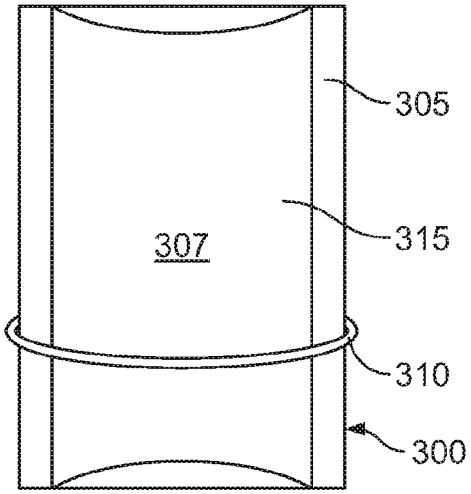

FIGS. 9*a* and 9*b* are top and bottom views, respectively, of the filler platform 300 with a strap 310.

Figure 9C:
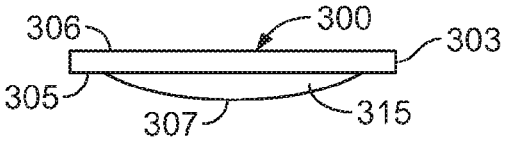
Figure 6D:
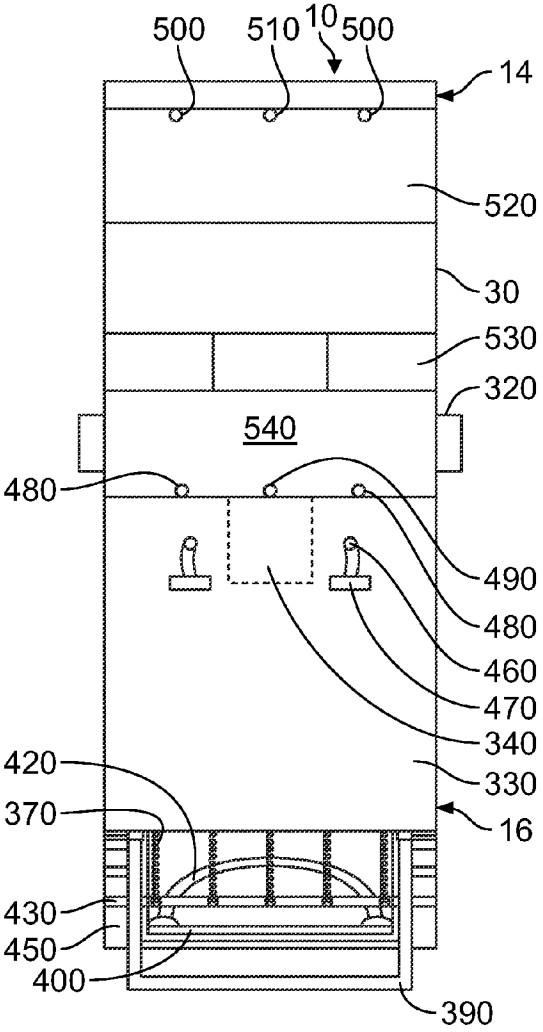
Figure 6C:
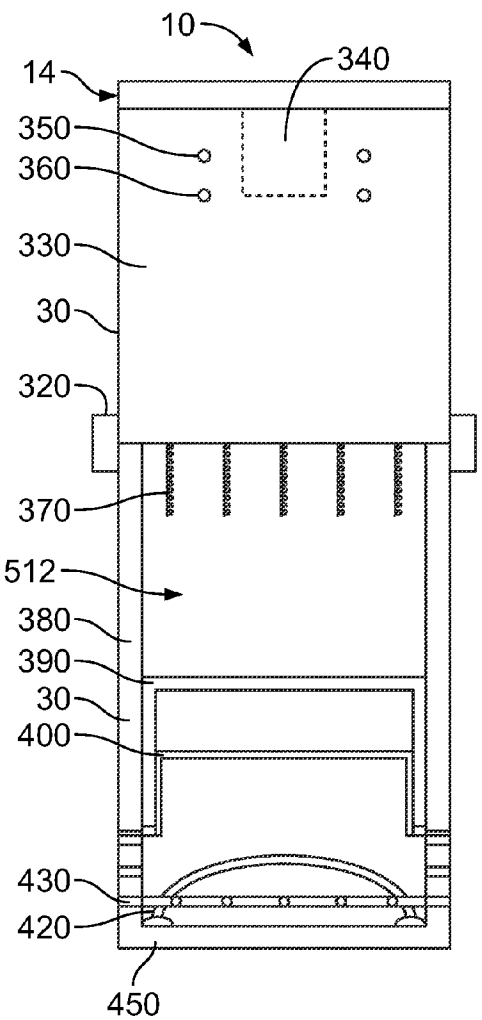
Figure 6B:
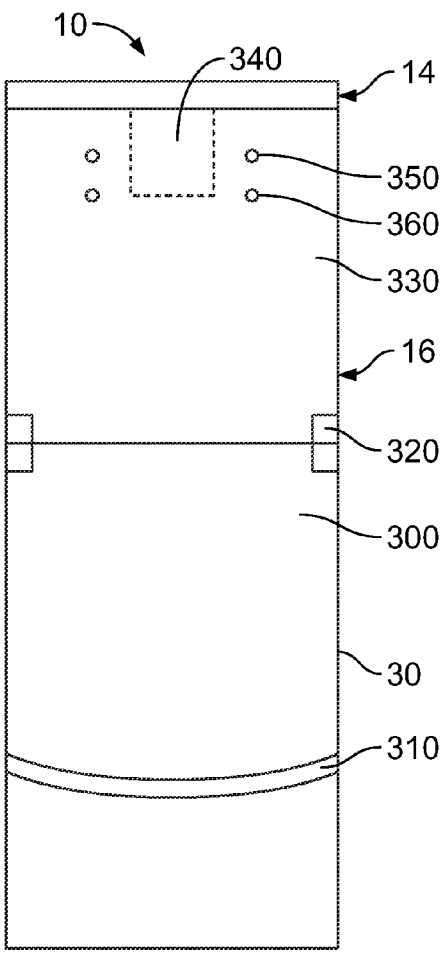
Figure 7C:
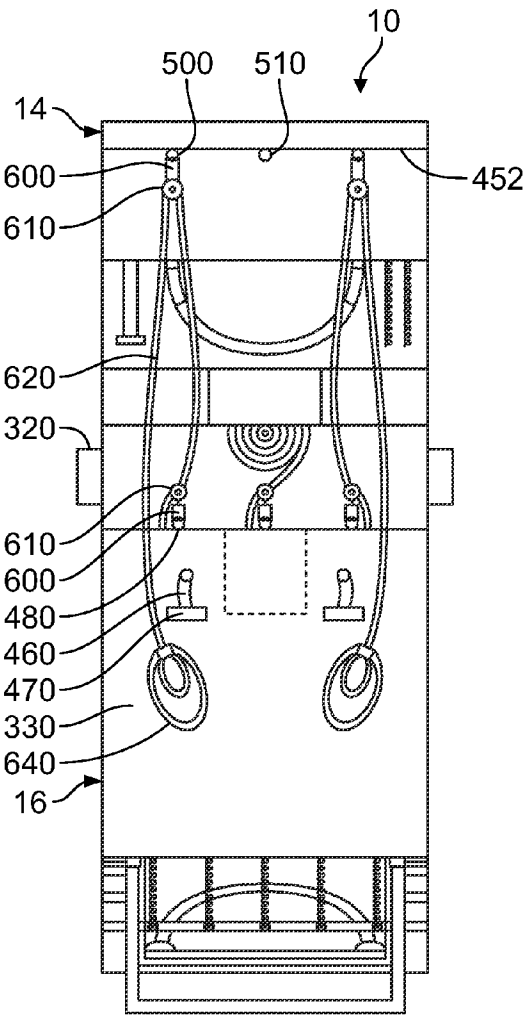
Figure 7B:
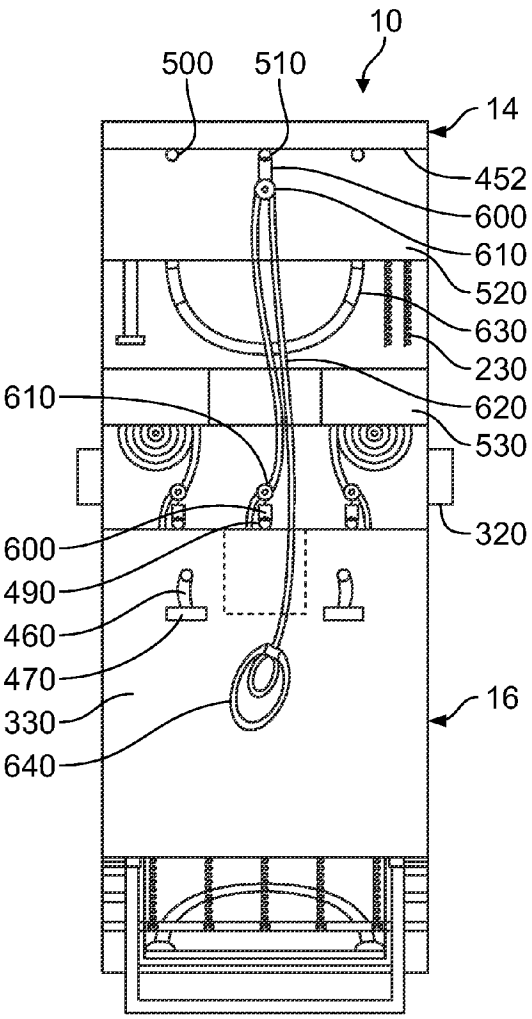
Figure 7A:
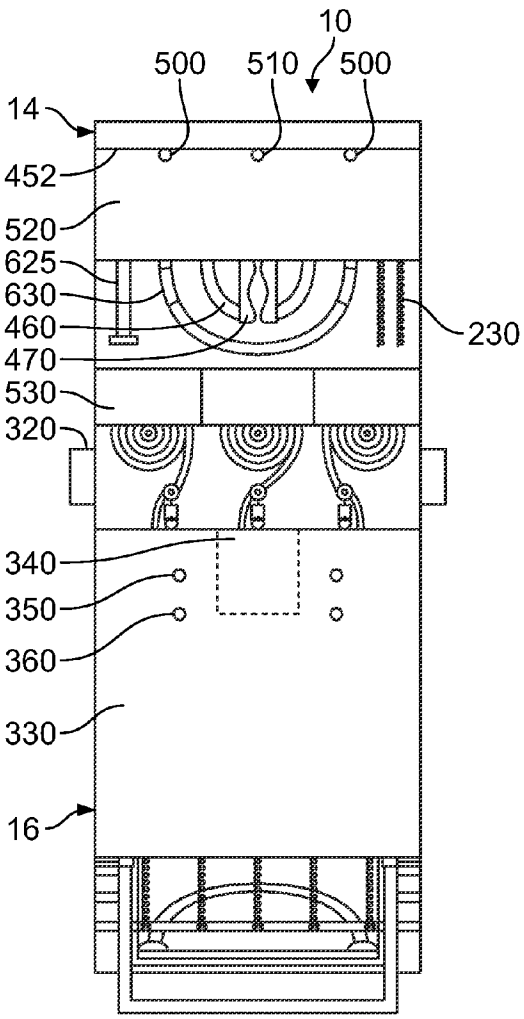
Figure 8A:
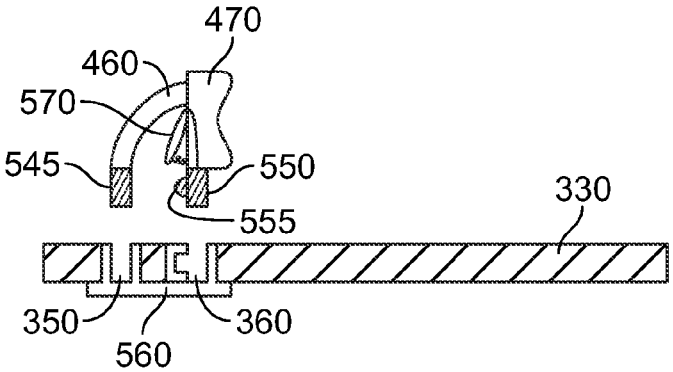
Figure 8B:
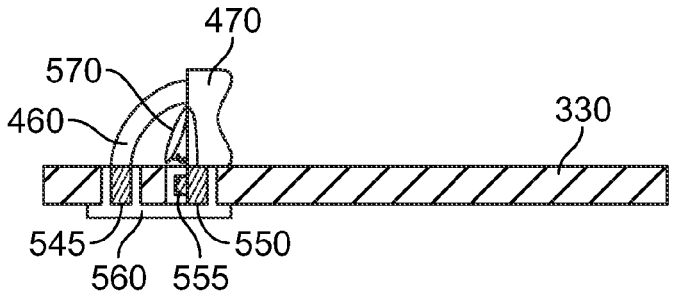
Figure 9A:
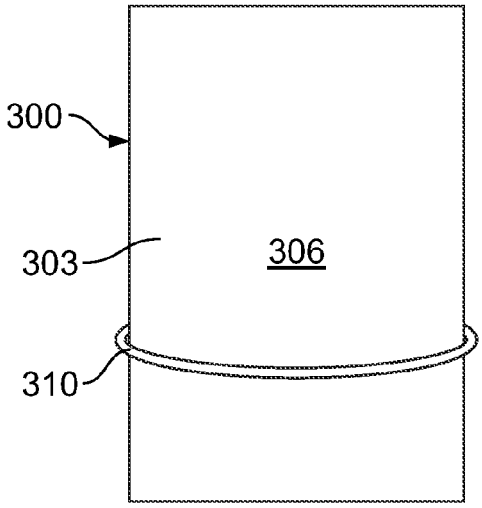
Figure 9B:
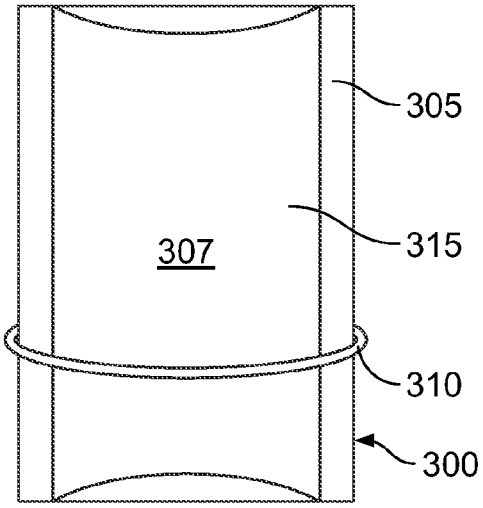
Figure 9C:
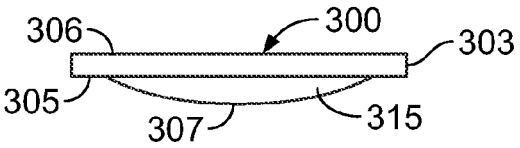

FIG. 9*c* is an end view of the filler platform 300 shown in FIGS. 9*a* and 9*b*, without the strap 310.

Figure 10C:
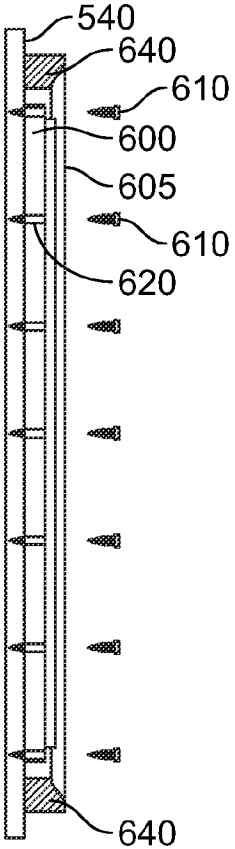
Figure 10B:
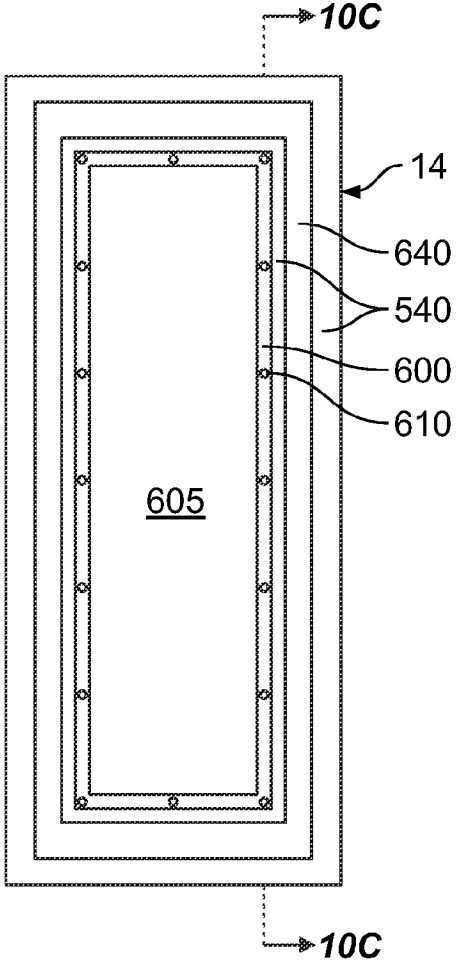
Figure 10A:
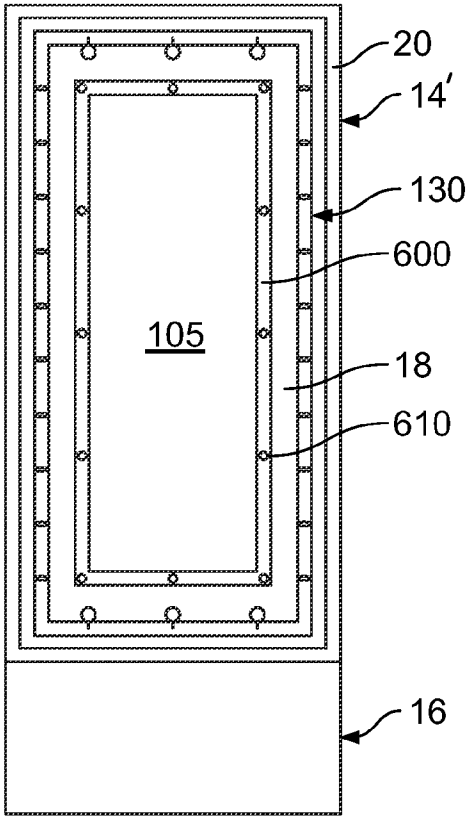

FIG. 10*a* is a front elevation view of the Pilates module 10, with the floor unit 16 in the lowered position, and showing an alternative mirror mounting arrangement within the wall unit 14.

FIG. 10*b* is a front elevation view of the Pilates module 10, with the floor unit 16 in the raised position for storage, showing a mirror 605 mounted on the exposed face of the lower panel 540 of the floor unit 16.

FIG. 10*c* is a partial sectional view taken along line 10*c*-10*c* of FIG. 10*b*.

Figure 11:
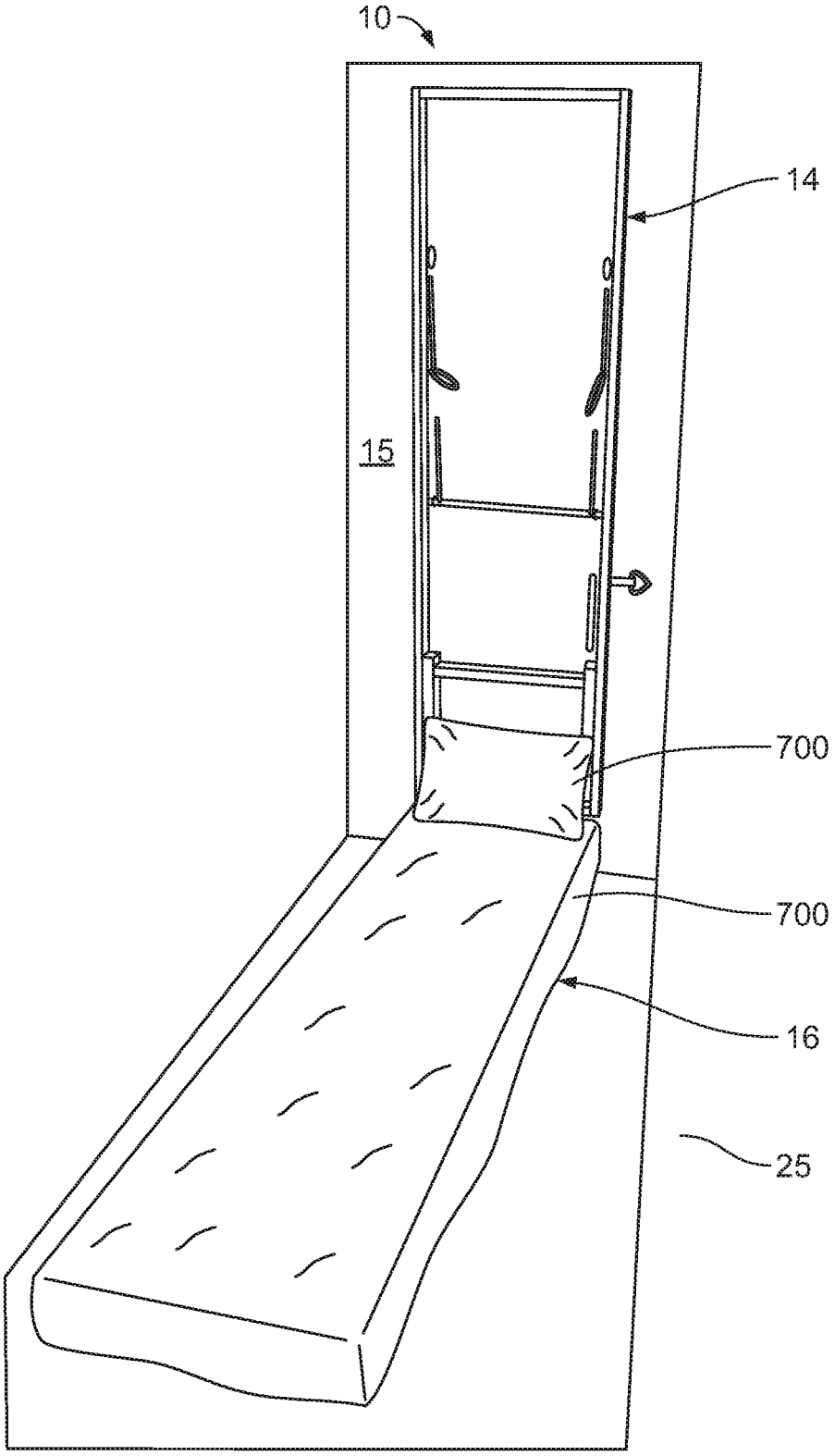

FIG. 11 is a front perspective view of the Pilates module 10 of the exercise apparatus 2 of FIGS. 1*a* and 6*a*, with the floor unit 16 in the lowered position and having bedding over the filler platform 300 and carriage platform 330.

It is to be understood that both the foregoing general description and the following detailed description are exemplary and provided for purposes of explanation only, and are not restrictive of the subject matter claimed. It also should be understood that the drawings are not to scale. While some mechanical details of example exercise apparatus, including other plan and section views of the examples shown and of examples that may have alternative configurations, have not been included, such details are considered well within the comprehension of those of skill in the art in light of the present disclosure. It also should be understood that the present invention is not limited to the example embodiments illustrated. Further features and objects of the present disclosure will become more fully apparent in the following description of the preferred embodiments and from the appended claims.

DETAILED DESCRIPTION OF THE PREFERRED EMBODIMENTS

For the following defined terms, these definitions shall be applied, unless a different definition is given in the claims or elsewhere in this disclosure. As used in this disclosure and the appended claims, the singular forms "a", "an", and "the" include plural referents unless the content clearly dictates otherwise. As used in this disclosure and the appended claims, the term "or" is generally employed in its sense including "and/or" unless the content clearly dictates otherwise.

Referring generally to FIGS. 1*a*-11, it will be appreciated that exercise apparatus of the present disclosure generally may be embodied within numerous configurations, and may be used in various ways to alter and enhance methods of exercising. Indeed, while acknowledging that all of the example configurations of exercise apparatus and accessories that may be connected thereto need not be shown herein, several examples are provided to better demonstrate that a variety of configurations and methods of use are contemplated.

Turning now to the drawings, FIG. 1*a* shows a front view of an example exercise apparatus 2 having three separate modules mounted in place to a wall, for example the wall of a Pilates studio. The left and right modules are Pilates modules 10 which will be described below in detail. In this example, each of the Pilates modules 10 may provide the functions of a conventional Pilates reformer and a conventional Pilates tower.

Figure 1B:
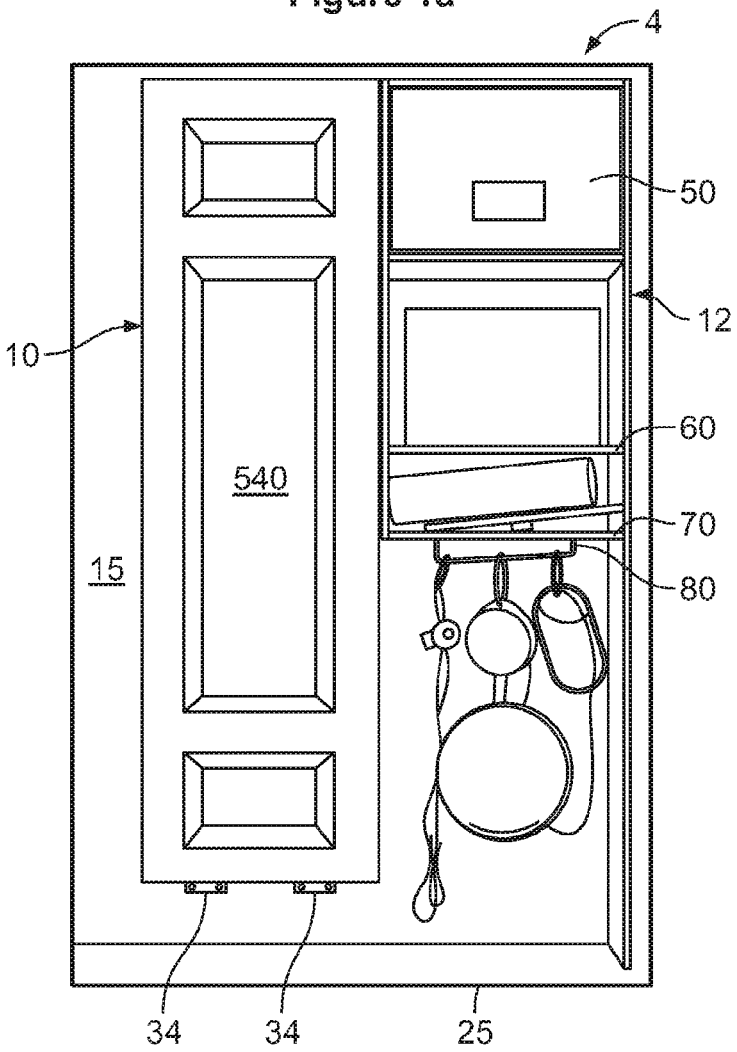
FIG. 1*b* is a front perspective view of an exercise apparatus 4 of another embodiment that includes two modules, the first being a Pilates module 10 and the adjacent second module being a storage module 12.

The center module of the example exercise apparatus 2 shown in FIG. 1*a* is a storage module 12 used to store Pilates accessories or other items. In this example, the storage module 12 includes an upper storage cabinet having a hinged cabinet door 50 that hinges upwardly, a large compartment shelf 60 and a small compartment shelf 70 that provide general-purpose shelf storage, and a railing 80 that allows a user to hang accessories as needed. FIG. 1*b* shows an alternative exercise apparatus 4 having a single Pilates module 10 and a single storage module 12, which are similar to those of the first example exercise apparatus 2, such as may be connected to a wall in a house or studio.

Various options exist for the exterior portion of the Pilates module 10 including, but not limited to, the following: a variety of finishes and colors, functional or decorative handles, decorative and protective trim, as well as a flexible or rigid mirror. Additionally, storage module 12 can be similarly finished along with a variety of customizable storage options including cabinets, shelves, drawers and cubbies.

Figure 2C:
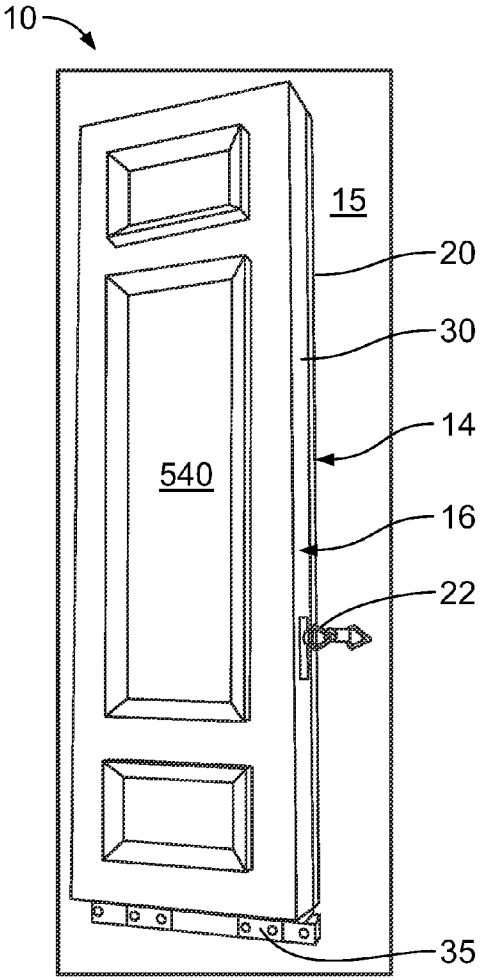
FIG. 2*c* is a front perspective view of the Pilates module 10 of the exercise apparatus 2 of FIG. 2*a*, with the floor unit 16 in the raised position.
Figure 2B:
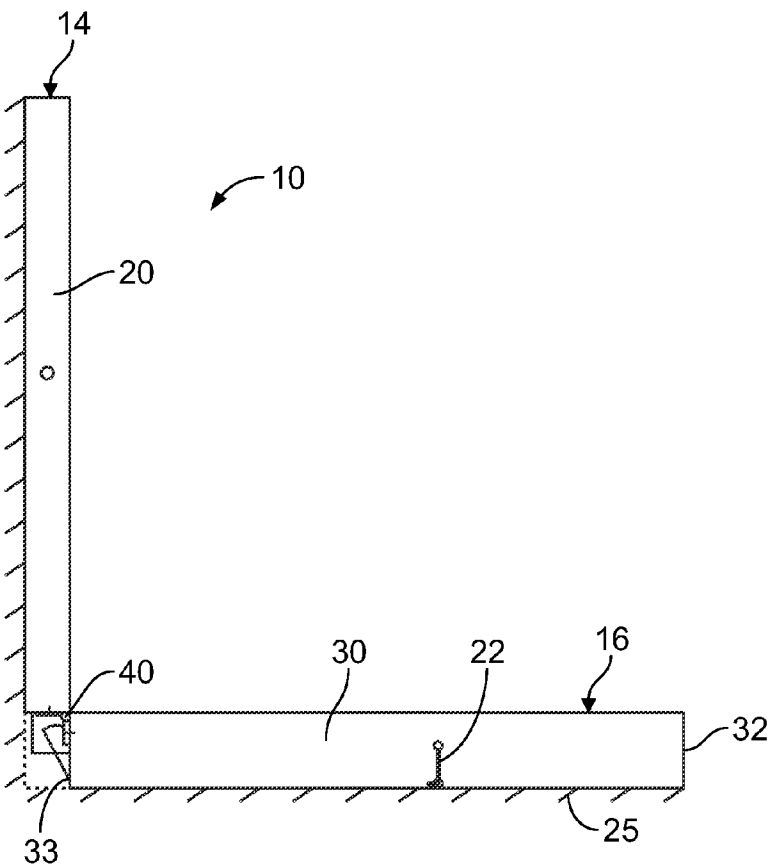
FIG. 2*b* is a side elevation view of the Pilates module 10 of the exercise apparatus 2 of FIG. 2*a*, with the floor unit 16 in the lowered position.
Figure 2A:
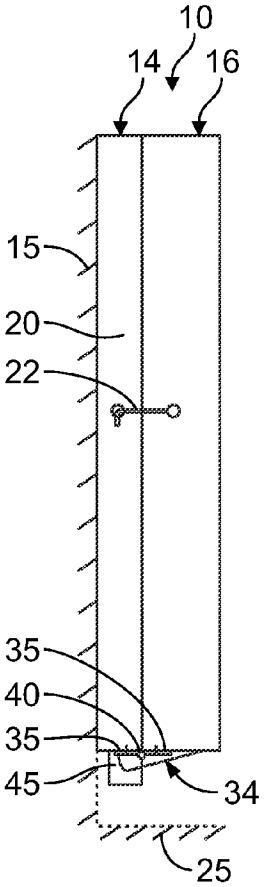
FIG. 2*a* is a side elevation view of the Pilates module 10 of the exercise apparatus 2 of FIGS. 1*a* and 1*b*, with the floor unit 16 in the raised position.
Figure 2D:
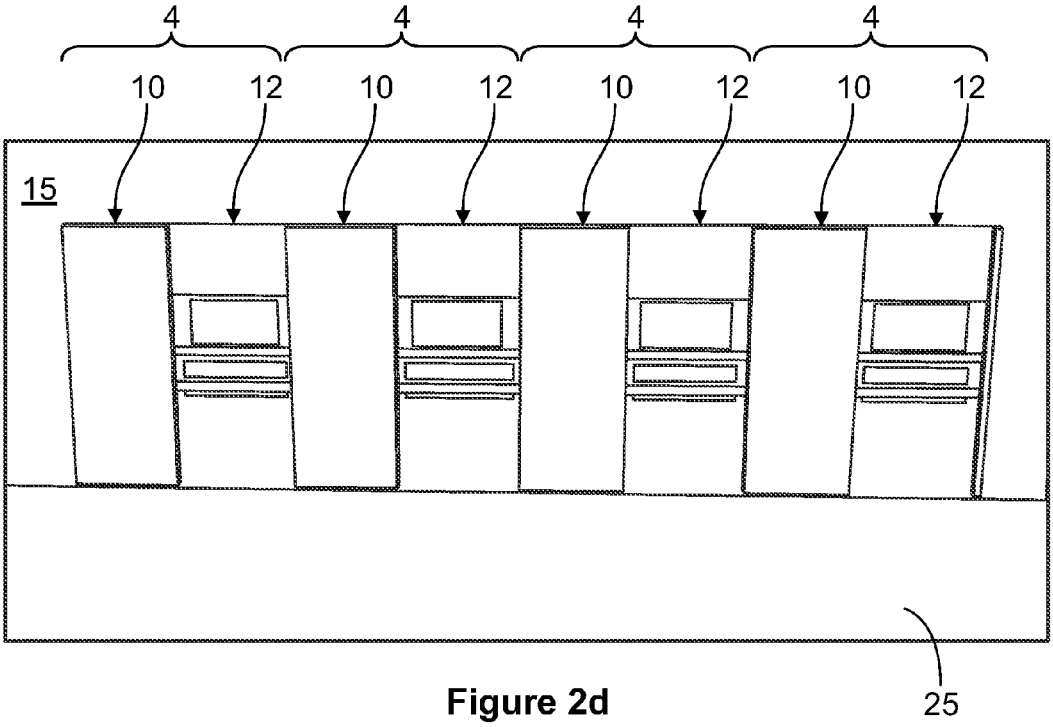
FIG. 2*d* is a schematic representation showing that multiple exercise apparatus modules, including both Pilates modules 10 and/or storage modules 12 of FIGS. 1*a* and 1*b*, may be installed in larger numbers along walls, such as in an exercise studio, while leaving the floor space generally unimpeded.
Figure 2E:
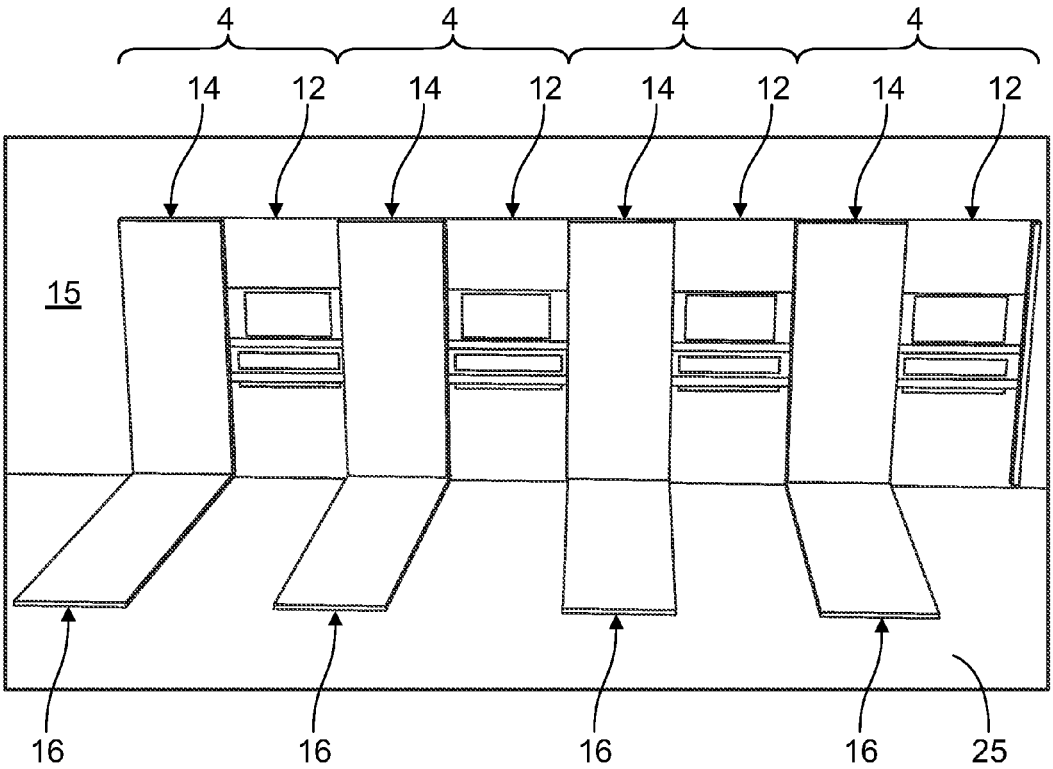
FIG. 2*e* is a further schematic representation of the exercise apparatus modules shown in FIG. 2*d* when in a position for use with wall units 14 mounted to a wall and floor units 16 in a lowered position, engaging the floor.

FIGS. 2*a* and 2*b* are side views of the Pilates module 10 of the exercise apparatus 2, in the raised and lowered positions, respectively. Each Pilates module 10 includes a wall unit 14 and a floor unit 16. The wall unit 14 is securely connected to an adjacent wall 15, and the floor unit 16 is mounted to hinge or pivot relative to the wall unit 14 by one or more hinges 34. Each hinge 34 includes first and second hinge leaves 35 pivotally connected together by a hinge pivot 40. Each of the hinge leaves 35 is secured to either a respective one of the wall unit 14 or the floor unit 16. In this example, the hinge pivots 40 are arranged horizontally and parallel to the wall 15 such that the floor unit 16 can be pivoted between the raised position for storage shown in FIG. 2*a* and the lowered position for use shown in FIG. 2*b*. In the raised position of FIG. 2*a*, the floor unit 16 lies adjacent to the wall unit 14, and it is held in this raised position by a latch 22. In the lowered position shown in FIG. 2*b*, the floor unit 16 rests on the floor 25, at substantially a right angle to the wall unit 14. A closing mechanism, schematically shown at 45, may provide a counterbalancing, lifting force that helps a user move the floor unit 16 between the raised and lowered positions. The closing mechanism 45 can operate mechanically using springs, hydraulically or electrically.

The structure of the wall unit 14 can vary widely, depending upon the needs of the user. In one alternative (not shown) the rear wall of the wall unit may be simply an unfinished blank surface, without additional structure between the side panels 20. Alternatively, the wall unit 14 can include a decorative surface, a flexible or rigid mirror, and a selection of hooks and hubs to allow various accessories to be releasably mounted to and between the side panels 20, as needed.

FIGS. 3*a* and 3*b* show two alternative versions of the wall unit 14, 14'. As shown in FIG. 3*a*, the wall unit 14 includes a frame 90 made up of two parallel spaced apart first side supports 20 that are interconnected by a top support 26 and a bottom support 28. The frame 90 can be made of wood or metal, for example, and it is securely connected to the adjacent wall. Rings such as eyebolts 110 are secured to the frame 90, as shown, and provide significant flexibility for fixturing, as they can be used to selectively mount exercise devices, such as conventional Pilates accessories including springs, pulleys and the like. Hubs 100 (described in detail below) are mounted to the first side supports 20 to receive accessory bars such as push bars and pull or roll-back bars. An optional rigid mirror 105 is mounted within the dimensions of the frame 90. These features of the wall unit 14 support the accessories that allow a user to perform exercises, such as Pilates exercises, as on a conventional Pilates tower.

The alternative wall unit 14' of FIG. 3*b* includes a frame 90 and a mirror 105 as described above. In this alternative construction, however, the frame 90 supports an interior accessories frame 130 that may be formed of metal pieces, such as tubes that are welded or otherwise connected together at the corners. The interior accessories frame 130 supports hubs 140 that function like the hubs 100 and rings 142 that function like the eyebolts 110. Alternately or additionally, the interior accessories frame 130 advantageously may be separately mounted to an adjacent wall or base and used without connection to a wall unit 14'.

FIG. 4*a* shows how the wall unit 14 can be used to support exercise accessories, such as Pilates accessories. The hubs 100 support an accessory bar 170, as described below in connection with FIGS. 5*a*-5*e*. In this case, the accessory bar 170 pivots in the manner of a conventional Pilates push-through bar, except that it is not allowed to rotate past the vertical because of the nearness of the mirror 105. The accessory bar 170 is provided on both the front and back with elastomeric bumpers 150 to protect the mirror 105 from impact with the accessory bar 170. Alternatively, an intermediate frame may be used to space the accessory bar 170 further from the mirror 105 or back wall of the wall unit 14. Various Pilates accessories can be releasably mounted to the rings or eyebolts 110, and positioned as needed. For example, a conventional Pilates Reformer roll-back bar 190 can be secured in place to the rings or eyebolts 110 by releasable clips 200. The releasable clips 200 are provided with elastomeric bumpers to protect the mirror 105 from impact. Other exercise accessories maybe mounted to the rings or eyebolts 110, such as conventional Pilates Reformer springs 230 and hand/foot straps 220, and the like. Releasable clips 200 with bumpers also may be used here.

FIG. 4*b* shows related features of the wall unit 14'. The accessory bar 170 may be mounted and used as described above, and in this case another accessory bar 170' is provided. Multiple rings 142 are mounted to this accessory bar 170', and these rings 142 are used to support any desired Pilates accessories, such as a conventional Pilates Reformer roll-back bar 190, conventional Pilates Reformer springs 230 and hand/foot straps 220 by means of releasable clips 200 with bumpers.

FIGS. 5*a*-5*g* show further details of the accessory bars 170, 170'. FIG. 5*a* shows the accessory bar 170 removed from the frame 90 of wall unit 14, or accessories frame 130 of wall unit 14'. The accessory bar 170 may include a rigid, U-shaped frame 160 that forms a push bar. The ends of the accessory bar 170 each support a respective splined end 195 that is mounted to move into and out of the accessory bar 170 as controlled by the handle 180. The accessory bar 170' of FIG. 5*b* is similar to the accessory bar 170, except that the accessory bar 170' has no frame 160 and instead includes rings 142.

FIG. 5*c* shows the handles 180 in a first position, in which the ends 195 are held in an intermediate position. In this position, each end 195 is received in the hub 100,140 as shown in FIG. 5*f*. Because the external splines 198 of the end 195 are axially spaced from the internal splines 199 of the hub 100,140, the ends 195 are free to rotate in the hubs 100, 140 but not to move out of the hubs 100, 140. This first position is useful for when the user rotates the accessory bar 170' about the long axis of the accessory bar 170' during Pilates exercises.

FIG. 5*d* shows the handles 180 moved to a second position, in which they retract the splined ends 195 into the accessory bar 170'. In this position the user can move the accessory bar 170' into position within the frame 90, 130 to have the ends 195 inserted into the aligned hubs 100, 140 (by returning the handles 180 to the first position) or to remove the accessory bar 170' from the accessory frame 90, 130 of the wall unit 14, 14', or from an accessory frame 130 separately mounted to a wall or a base.

FIG. 5*e* shows the handles 180 moved to an optional third position, in which the splined ends 195 are extended farther out of the accessory bar 170' than in the first position. In this third position, the external splines 198 of the ends 195 interlock with mating internal splines in the hubs 100, 140, as shown in FIG. 5*g*, to lock the accessory bar 170' in a selected rotational position.

The mechanism coupling the handles 180 with the ends 195 is not shown in detail, but it will be understood that many alternative mechanisms may be adapted for this use. For instance, the mechanism may be constructed similarly to the mechanisms that lock and unlock telescoping handles in certain rolling suitcases. Alternatively, the handles 180 may be connected to the ends 195 and slide in grooves formed in the accessory bar 170, 170' to allow the user direct control over the extent to which the ends 195 protrude from the accessory bar 170, 170'.

FIG. 6*a* shows a Pilates module 10 of an exercise apparatus 2 with the floor unit 16 in a lowered position. FIGS. 6*b*-6*dc* show various features of the floor unit 16 in greater detail, as seen from above. FIG. 6*b* shows the floor unit 16 with both a filler platform 300 and a sliding carriage platform 330 held in position by a bracket 320. This bracket 320 is movable between a retaining position as shown in FIG. 6*b*, in which the bracket 320 prevents the abutting edges of both platforms 300, 330 from moving away from the floor unit 16, and a releasing position as shown in FIG. 6*c*, in which the bracket 320 allows the filler platform 300 to be lifted out of the floor unit 16. The filler platform 300 also may include a conventional adjustable Pilates Reformer strap 310. The carriage platform may include a conventional Pilates Reformer adjustable headrest 340 and sockets 350, 360 shaped and positioned to receive conventional Pilates handgrip bars 460 and shoulder rests 470 (FIG. 6*d*).

FIG. 6*c* shows the floor unit 16 with the filler platform 300 removed to reveal conventional Pilates components that may be included at the distal end of the floor unit 16, farthest from the wall unit 14. Conventional Pilates Reformer springs 370 may be mounted to the underside of the carriage platform 330, which may be guided by rails 380 that are mounted in the floor unit 16, for movement of the carriage platform 330 toward and away from the conventional fixed rail 450. A conventional Pilates Reformer foot bar 390 may be pivotally mounted to the second side supports 30 of the floor unit 16, and a conventional Pilates Reformer support bar 400 may brace the foot bar 390 in a use position. A conventional Pilates Reformer ankle strap 420 is secured to the fixed rail 450, and a conventional Pilates Reformer spring attachment bar 430 extends and adjusts between the second side supports 30. The spring attachment bar 430 may be provided with spaced spring attachments, such as metal rings, hooks or notches in the bar that are held in place in any suitable manner.

FIG. 6*d* shows the floor unit 16 with the filler platform 300 removed and the movable carriage platform 330 shifted away from the adjacent wall unit 14 to show further internal features of the floor unit 16. The entire underside of the floor unit 16 may be covered with a panel 540 that is shown best in FIGS. 1*b* and 2*c*. This panel 540 is connected to the spaced apart second side supports 30 of the floor unit 16, so as to cover the internal components and accessories of the floor unit 16 when in the raised position of FIGS. 1*b* and 2*c*. This panel 540 also creates a large storage compartment 512 in the floor unit 16, bounded on the sides by the second side supports 30, on the ends by end of supports 32, 33 of the wall unit 16, and on the remaining large faces by the panel 540 on one side and the platforms 300, 330 on the other side.

Two spaced attachment points 500 for a conventional dual-rope Pilates Reformer pulley system may be mounted on a fixed rail 452 positioned to extend across the floor unit 16 at the opposite end from the fixed rail 450. Also, a centered attachment point 510 is advantageously mounted on the fixed rail 452 for a single-rope pulley system that can be used instead of the conventional dual-rope Pilates Reformer pulley system. The lower panel 540 additionally supports an accessory storage compartment 520 and a cable, rope, and strap storage compartment 530. Both of these compartments or pouches 520, 530 may be constructed of any suitable material such as fabric, wood, or plastic to hold exercise accessories, such as Pilates accessories, cables, ropes and straps in position as the floor unit 16 is moved to the raised position.

FIG. 6*d* also shows two shoulder rests 470 and two handgrip bars 460 releasably connected to the carriage platform 330. These elements function in use as do the corresponding conventional Pilates Reformer elements, but they are releasably held in place on the carriage platform 330 as discussed below in connection with FIGS. 8*a* and 8*b*. In FIG. 6*d*, spaced insertion points 480, 490 are shown on one underside edge of the carriage platform 330. The insertion points 480 may be used to hold two spaced ropes or straps and to allow each to be adjusted in length in the conventional manner. The single, centered insertion point 490 performs the same function when only a single, centered rope or strap is used.

FIGS. 7*a*, 7*b*, and 7*c* show how the floor unit 16 may be rigged for use after it is lowed to the floor. Once the bracket 320 is moved to the releasing position, the filler platform 300 is removed, and the carriage platform 330 is moved away from the wall unit 14, as shown in FIG. 7*a*, then various stored exercise accessories are visible. In this example, a conventional Pilates bar 625, ring 630, springs 230 and shoulder rests 470 are shown, held in place in a pocket formed by the storage compartment 520.

FIG. 7*b* shows the floor unit 16 rigged for use with a single rope, cable and/or strap. Here, a single cable 620 from the center pocket of the storage compartment 520 may be secured to the underside of the carriage platform 330 at the central insertion point 490 by a conventional cam cleat (not shown). This cable 620 passes through a pulley 610, which may be connected to the fixed rail 452 at the central attachment point 510 by a releasable fastener or clip 600. The cable 620 also is guided by an additional pulley 610 that may be connected to the carriage platform 330 near the central insertion point 490 by a releasable fastener or clip 600. This additional pulley improves cable control when the first-named pulley is positioned above the plane of the carriage platform 330. A conventional Pilates Reformer hand/foot strap 640 may be connected to the free end of the cable 620 by a releasable fastener or clip 600 for use in a conventional manner. Since the single cable 620 is coupled to the central part of both the carriage platform 330 and the fixed rail 452, forces applied by the cable 620 to the carriage platform 330 and the rail 452 are balanced, and no more than a single cable is needed for smooth operation.

FIG. 7*c* shows a conventional double-rope configuration, in which two cables 620 are used, each coupled to a respective side of the carriage platform 330 at a respective attachment point 480, and each passing through a respective pulley 610 that is connected to a respective side of the fixed rail 452 at a respective attachment point 500 by a releasable fastener or clip 600. As in FIG. 7*b*, additional pulleys are connected to the carriage platform 330 near the respective attachment points 480.

FIGS. 8*a* and 8*b* show in partial section how the shoulder rest 470 and handgrip 460 are releasably connected to the carriage platform 330. The shoulder rest 470 has an insertion end 550, which has a side-facing locking element 555. This locking element 555 is spring biased outwardly to the position shown in FIG. 8*a*, but the locking element can be retracted into the insertion end 550 by a manually-operated release 570. The handgrip 460 also has an insertion end 545. To install the combined shoulder rest 470 and handgrip 460 on the carriage platform 330, the insertion ends 550, 545 are aligned with the respective sockets 360, 350; the release 570 is pressed to move the locking element 555 into the insertion end 550; and then the insertion ends 550, 545 are moved into the respective sockets 360, 350 and are permitted to selectively engage the sockets of the carriage platform 330 to complete the installation. The combined headrest 470 and handgrip 460 can be removed from the carriage platform 330 by using the release 570 to move the locking element 555 into the insertion end 550 and then lifting the insertion ends 550, 545 out of the sockets 360, 350. If desired, a reinforcing plate 560 can be used to strengthen the carriage platform 330 around the sockets 350, 360.

FIGS. 9*a*-9*c* show further features of the filler platform 300 from the floor unit 16. In particular, FIG. 9*b* shows that the filler platform 300 has a curved component 315 that extends from the lower surface or underside 305 of a panel 303 having a generally flat upper surface 306. The curved component 315 may be formed with or connected to the flat panel 303. As shown in FIG. 9*c*, the curved component 315 defines a protruding lower surface 307 that includes at least one convex portion, which in this example is generally cylindrically convex. This allows the filler platform 300 to be placed on the floor and used as a balancing platform to use during exercises, such as Pilates exercises, with either the flat panel 303 facing upward or the protruding lower surface 307 facing upward. This provides an extra function for the filler platform 300, beyond supporting a user on or closing the compartments in the floor unit 16. In alternative embodiments, the curved component 315 can be formed of wood, plastic, rubber or foam, whether solid, hollow or inflatable, and it can be divided into two or more spaced parts that cover a smaller fraction of the underside or lower surface 305 to reduce its weight, and the filler platform 300 may be used on other exercise equipment, such as benches for weight lifting, or the like. Also, the curved component 315 may be provided with protruding surfaces of other shapes, such as a domed-convex lower surface or a ridge of any desired cross-sectional shape.

FIG. 10*a* shows that a mirror 105 can be releasably mounted to the wall unit 14, internally. As shown in FIG. 10*a*, the wall unit 14 includes a panel 18 that extends between the first side supports 20 adjacent the wall. A mirror 105 may be secured to a support 600, which may be a wooden panel, adhesively or by other suitable fastening means, such as by use of fasteners and clips. The support 600 may be secured to the panel 18 by suitable fastening means, as for example adhesively or releasably by screws 610. The screws 610 may be wood screws, or alternatively they may be machine screws that screw into metal threaded inserts in the panel 18. This arrangement allows the mirror 105 to be replaced easily, if necessary.

FIGS. 10*b* and 10*c* show how a mirror 605 can be mounted externally on the lower or outer side of the panel 540 of the floor unit 16, such that the mirror 605 may serve as a wall mirror when the floor unit 16 is in the raised position. In FIG. 10*b*, the external mirror 605 may be adhesively connected to a support 600, as above described for the mirror 105 that may be mounted to the wall unit 14, internally. The support 600 is secured to the outer surface of the lower panel 540, as for example by screws 610, clips or other fasteners or the like. Similarly to that discussed above, the example screws 610 may be wood screws, or alternatively they may be machine screws that screw into metal threaded inserts in the panel 18. As with the internal wall unit mirror 105, this arrangement for the external floor unit mirror 605 permits the mirror to be replaced easily, if necessary.

FIG. 10*c* is a partial section view that shows the screws 610 pass through openings 620 in the support 600 and are connected to the outer surface of the lower panel 540. An example raised decorative trim 640 surrounds the support 600 and protects the mirror 605 from contact with the floor when the floor unit 16 is moved to the lowered position, although it will be understood that other structures maybe extend from the outer surface of the lower panel, such as legs or the like, that may support the lower panel above the floor.

Operation

The Pilates module 10 of the example exercise apparatus 2 is stored with the floor unit 16 in the raised position of FIGS. 1*a*, 1*b* and 2*a*. In the raised position of this example configuration, the lower panel 540 of the floor unit 16 becomes the external, exposed front of the module 10, and the second side supports 30 of the floor unit 16 are visible alongside the first side supports 20 of the wall unit 14. With this configuration having a mirror and/or other trim on the external surface of the lower panel 540 and the floor unit 16 being pivotal relative to the wall unit 14, no additional cabinet doors are needed to hide the underside of the raised floor unit 16. Instead, the face of the cabinet of the Pilates module 10 of the exercise apparatus 2 is provided by the lower panel 540 and merely lifting the floor unit 16 to its raised position provides an uncluttered, sleek cabinet appearance for the stored exercise apparatus 2.

The floor unit 16 may be pivoted down to the lowered position of FIG. 2*b* for use in exercising. In this position, the large storage compartment formed by the two second side supports 30, the end supports 32, 33, the filler platform 300, carriage platform 330, and the lower panel 540 may be opened by moving the bracket 320 to the releasing position and removing the filler panel 300. This exposes the contents of the storage compartment 512, shown in FIG. 6*c*. The desired exercise accessories, such as Pilates components and the like, then may be removed from the storage compartment and installed on the wall unit 14 and the floor unit 16 to configure the exercise apparatus 2 for use in exercising, such as is shown with the Pilates module 10.

The movable carriage platform 330 also may be moved to access exercise accessories in the further storage compartments 520, 530. After use, the various accessories may be returned to the storage compartments, the filler platform 300 may be placed on the second side supports and retained in place with the bracket 320 moved to the retaining position. The floor unit 16 then may be lifted to the raised position shown in FIGS. 1*b*, 2*a* and 2*c*, and held in place, such as by a biasing lift mechanism or a latch.

As noted previously, the filler platform 300 may be placed directly on the floor and used as a balancing platform after it has been removed from the floor unit 16. Thus, the filler platform may perform three separate functions: (1) filling the upper surface of the lowered floor unit 16 to provide a larger surface that can be used for exercise or as a bed, as shown in FIG. 11 with a bed sheet, cover and/or other bedding 700 covering the carriage platform and the filler platform; (2) enclosing the large storage compartment 512 to improve retention of exercise accessories in the compartment; and (3) providing a balance platform for use on a floor. This improved filler platform 300 may be used with any Pilates Reformer or exercise bench to add a balance platform function efficiently.

The centered attachment points 110, 142, 510 and the centered insertion point 490 allow increased flexibility in advantageously rigging the carriage platform 330 for single-cable use, because the single cable and associated spring may apply centered forces to the movable carriage platform 330.

The cable system of the Pilates module 10 of the exercise apparatus 2 provides great flexibility of use, because the pulleys can be connected with the releasable clips to the attachment points on the floor unit 16, to the rings on the frame 90 of the wall unit 14, or to the rings on the optional accessories frame 130 of the wall unit 14'.

Additional Alternatives

The wall unit 14 may be held in place in many ways. It may be fixed or removably secured to a wall as above described. Alternatively, the wall unit 14 may be connected to a floor, or it may be configured as a freestanding unit that rests on the floor. In this last alternative, two wall units may be placed back-to-back facing away from one another, without any wall between them.

The floor unit 16 may be pivotally mounted in many ways. It may be hinged to the wall unit 14 with the hinge axes either positioned below the wall unit 14, as discussed above, or positioned on an interior or exterior portion of the wall unit 14, relative to the first side supports 20. The floor unit 16 also may be pivotally mounted directly to the wall 15 or the floor 25.

The second side supports 30 of the raised floor unit 16 may abut the first side supports 20 of the wall unit 14, as shown in FIG. 2*a*. Alternatively, the second side supports 30 of the raised floor unit 16 can nest within the first side supports 20 of the wall unit 14, either partially or fully, or overlap along the outer sides thereof.

The bracket 320 is only one of several types of retainers that can be used to control the movement of and retain or release the platforms 300, 330. For example, retaining straps or separate sliding bolts or fixtures for each of the platforms 300, 330 also may be used.

A rounded convex component may extend from to the underside of the carriage platform 330, such that the carriage platform 330 may be removed and used as a balance platform, in addition to or instead of the previously described filler platform 300 having a convex lower surface.

A wide variety of springs may be used to create resistance and/or spring bias the movement of the carriage platform 330, including conventional Pilates Reformer springs and elastic cables or straps.

As shown in FIG. 11, the Pilates Module 10 may be provided with bedding 700 that allows the lowered floor unit 16 to be used as a bed. For example, bed sheets, covers or the like may be placed over the platforms 300, 330 to conveniently make a bed.

Given the numerous, convenient ways in which the example exercise apparatus may be quickly, conveniently and safely moved between a position for use and a storage position, it will be appreciated that a user now can readily use the exercise apparatus in a relatively small area, but also utilize the area for other exercises or uses by raising the floor unit to its raised, stored position.

From the above disclosure, it will be apparent that exercise apparatus and storage units constructed in accordance with this disclosure may include a number of structural aspects that provide numerous advantages over conventional exercise equipment. The example exercise apparatus shown herein may exhibit one or more of the above-referenced potential advantages, depending upon the specific design chosen.

It will be appreciated that exercise apparatus constructed in accordance with the present disclosure may be provided in various configurations. Any variety of suitable materials of construction, configurations, shapes and sizes for the components and methods of connecting the components may be utilized to meet the particular needs and requirements of an end user. It will be apparent to those skilled in the art that various modifications can be made in the design and construction of such exercise apparatus without departing from the scope or spirit of the claimed subject matter, and that the claims are not limited to the preferred embodiments illustrated herein. It also will be appreciated that the example embodiments may be shown in simplified form, so as to focus on the key components and to avoid including structures that are not necessary to the disclosure and that would over complicate the drawings.

A wide range of changes and modifications may be made to the above described preferred embodiments. It is, therefore, intended that the invention be defined by the following claims, and that the invention not be limited to the specific above described examples.

The invention claimed is:

1. An exercise apparatus for use in a room having a floor and a wall, said apparatus comprising:

a. a wall unit configured to be connected to and extend parallel to the wall, wherein the wall unit further comprises spaced apart wall unit side supports that extend outward from the wall;

b. a floor unit pivotally connected to the wall unit and being rotatable between a raised position substantially parallel to the spaced apart wall unit side supports and a lowered position extending outward from the wall and being adjacent or above and substantially parallel to the floor, said floor unit further comprising:

i. a pair of spaced apart floor unit side supports having a length;

ii. a carriage platform being movable between and along the length of the pair of spaced apart floor unit side supports;

iii. at least one spring coupled to the carriage platform to bias the carriage platform in a selected direction;

iv. at least one accessory coupled to the carriage platform and usable to move the carriage platform in a direction opposite the selected direction; and v. a removable filler platform positioned to extend between the pair of spaced apart floor unit side supports and adjacent to the carriage platform, with the filler platform further comprising a rounded convex component protruding from a lower surface of the filler platform such that when the filler platform is removed from the floor unit the filler platform is configured for use as a balancing platform on the floor; and c. wherein while the floor unit remains in the lowered position, the carriage platform is slidable toward and away from the wall unit, and the selected direction is either toward or away from the wall unit; and d. wherein when the floor unit is rotated to the raised position, the floor unit maintains the length of the pair of spaced apart floor unit side supports over which the carriage platform is movable.

2. The apparatus of claim 1 wherein the spaced apart wall unit side supports and the spaced apart floor unit side supports are adjacent one another at respective sides of the wall unit when the floor unit is in the raised position.

3. The apparatus of claim 1 further comprising a storage unit configured as a cabinet and positioned adjacent to at least one of the spaced apart wall unit side supports and opposite the area between the spaced apart wall unit side supports.

4. The apparatus of claim 1 wherein the wall unit further comprises a mirror mounted between the spaced apart wall unit side supports.

5. The apparatus of claim 1 wherein the floor unit comprises a lower panel that is positioned adjacent or above the floor when the floor unit is in the lowered position.

6. The apparatus of claim 5 wherein the lower panel extends between the pair of spaced apart floor unit side supports and provides at least a portion of an external surface of the exercise apparatus when the floor unit is in the raised position.

7. The apparatus of claim 5 wherein the lower panel cooperates with the pair of spaced apart floor unit side supports to create at least one storage compartment in the floor unit, and the floor unit further comprises a removable filler platform that closes the at least one storage compartment.

8. The apparatus of claim 5 wherein the floor unit further comprises a mirror connected to an outer surface of the lower panel and wherein the floor unit further comprises components that extend from the outer surface of the lower panel and protect the mirror from contact with the floor when the floor unit is in the lowered position.

9. The apparatus of claim 1 wherein the floor unit further comprises a retainer that releasably retains the filler platform relative to the pair of spaced apart floor unit side supports and prevents inadvertent lifting of the filler platform.

10. The apparatus of claim 1 further comprising a pillow and a bedding cover extending over the carriage platform and the filler platform when the floor unit is in the lowered position.

11. The apparatus of claim 1 further comprising at least one shoulder rest that is releasably connectable to the carriage platform.

12. The apparatus of claim 11 wherein the shoulder rest further comprises a handgrip bar.

13. The apparatus of claim 1 wherein the at least one accessory further comprises a cable, rope or strap that is usable to pull the carriage platform in a direction opposite the selected direction.

14. An exercise apparatus for use in a room having a floor and a wall, said apparatus comprising:

a. a wall unit configured to be connected to and extend parallel to the wall, wherein the wall unit further comprises spaced apart wall unit side supports that extend outward from the wall;

b. a floor unit pivotally connected to the wall unit and being rotatable between a raised position substantially parallel to the spaced apart wall unit side supports and a lowered position extending outward from the wall and being adjacent or above and substantially parallel to the floor, said floor unit further comprising:

i. a pair of spaced apart floor unit side supports having a length;

ii. a carriage platform being movable between and along the length of the pair of spaced apart floor unit side supports, and further comprising a first attachment point centered between the pair of spaced apart floor unit side supports;

iii. at least one spring coupled to the carriage platform to bias the carriage platform in a selected direction; and iv. at least one accessory coupled to the carriage platform and usable to move the carriage platform in a direction opposite the selected direction; and c. wherein the wall unit further comprises a second attachment point centered between the spaced apart wall unit side supports, and said first attachment point of said floor unit and said second attachment point of said wall unit are operatively coupled to springs and cables to apply forces to the wall unit and to the carriage platform via the centered first and second attachment points;

d. wherein while the floor unit remains in the lowered position, the carriage platform is slidable toward and away from the wall unit, and the selected direction is either toward or away from the wall unit; and e. wherein when the floor unit is rotated to the raised position, the floor unit maintains the length of the pair of spaced apart floor unit side supports over which the carriage platform is movable.

15. The apparatus of claim 14 wherein the wall unit further comprises a mirror mounted between the spaced apart wall unit side supports.

16. The apparatus of claim 14 wherein the floor unit further comprises a removable filler platform positioned to extend between the pair of spaced apart floor unit side supports and adjacent to the carriage platform.

17. An exercise apparatus for use in a room having a floor and a wall, said apparatus comprising:

a. a wall unit configured to be connected to and extend parallel to the wall, wherein the wall unit further comprises spaced apart wall unit side supports that extend outward from the wall, and a frame having a vertical orientation and being connected to the spaced apart wall unit side supports, and at least one bar that is usable for exercising and that connects to the frame;

b. a floor unit pivotally connected to the wall unit and being rotatable between a raised position substantially parallel to the spaced apart wall unit side supports and a lowered position extending outward from the wall and being adjacent or above and substantially parallel to the floor, said floor unit further comprising:

i. a pair of spaced apart floor unit side supports having a length;

ii. a carriage platform being movable between and along the length of the pair of spaced apart floor unit side supports;

iii. at least one spring coupled to the carriage platform to bias the carriage platform in a selected direction; and iv. at least one accessory coupled to the carriage platform and usable to move the carriage platform in a direction opposite the selected direction; and c. wherein while the floor unit remains in the lowered position, the carriage platform is slidable toward and away from the wall unit, and the selected direction is either toward or away from the wall unit; and d. wherein when the floor unit is rotated to the raised position, the floor unit maintains the length of the pair of spaced apart floor unit side supports over which the carriage platform is movable.

18. The apparatus of claim 17 wherein the wall unit further comprises a mirror mounted between the spaced apart wall unit side supports.

19. The apparatus of claim 17 wherein the floor unit further comprises a removable filler platform positioned to extend between the pair of spaced apart floor unit side supports and adjacent to the carriage platform.

20. The apparatus of claim 17 wherein the frame is removably connected to the wall unit.

21. The apparatus of claim 17 further comprising accessories connectable to the at least one bar and the accessories having at least one protective bumper to avoid damage to other components.

22. The apparatus of claim 17 wherein the at least one bar further comprises extendible ends that are received in a plurality of hubs that are connected to the frame and each extendible end is movable to at least a first position wherein said extendible end is rotatable within one of the hubs and a second position wherein said extendible end is not rotatable within said hub.

23. The apparatus of claim 17 wherein the at least one bar is removable from the frame.

24. The apparatus of claim 17 further comprising a plurality of rings connected to the frame.

* * * * *